US007178498B2

(12) United States Patent
Takeuchi

(10) Patent No.: US 7,178,498 B2
(45) Date of Patent: Feb. 20, 2007

(54) LUBRICATION SYSTEM FOR AN ENGINE

(75) Inventor: Yoshihiko Takeuchi, Shizuoka (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 141 days.

(21) Appl. No.: 10/860,214

(22) Filed: Jun. 3, 2004

(65) Prior Publication Data

US 2004/0244761 A1 Dec. 9, 2004

(30) Foreign Application Priority Data

Jun. 3, 2003 (JP) ..... 2003-158473
Apr. 1, 2004 (JP) ..... 2004-109254

(51) Int. Cl.
*F01M 1/00* (2006.01)

(52) U.S. Cl. ..... 123/196 R

(58) Field of Classification Search ..... 123/196 R, 123/196 W, 198 C, 196 S
See application file for complete search history.

(56) References Cited

FOREIGN PATENT DOCUMENTS

JP 07-063119 3/1995
JP 2002-089217 3/2002

*Primary Examiner*—Stephen K. Cronin
*Assistant Examiner*—Katrina Harris
(74) *Attorney, Agent, or Firm*—Hogan & Hartson LLP

(57) ABSTRACT

A lubrication system for an engine includes an oil tank, a crankshaft, a crankcase for housing the crankshaft. An oil sump formed at a bottom of the crankcase collecting lubricant for circulated moving parts to be lubricated, and an oil pump for returning the lubricant collected in the oil sump to the oil tank are also provided. The oil sump and an oil suction port are provided, respectively, on one side and the another side of a normal plane including an axis of the crankshaft.

19 Claims, 24 Drawing Sheets

LUBRICATION SYSTEM FOR AN ENGINE

BACKGROUND OF THE INVENTION

1. Field of the Invention

This invention relates to a dry sump lubrication system which delivers a lubricant in an oil tank to moving parts to be lubricated in an engine by an oil pump, and returns the lubricant collected in an oil sump to the oil tank.

2. Description of Related Art

A single cylinder or two-cylinder engine with a large displacement generally causes a larger reciprocating mass of a piston and toque variations during a combustion stroke, compared to a multi-cylinder engine with the same displacement. Therefore, the single and two-cylinder engines tend to need a thick, large-diameter crank arm in order to increase the moment of inertia.

In addition, the single cylinder or two-cylinder engine with a larger cylinder internal volume inevitably has a larger crank throw radius and a longer piston stroke, compared to the multi-cylinder engine with the same displacement. Therefore, the single and two-cylinder engines tend to have an increased engine height. Specifically, a motorcycle, which has an engine mounted between front and rear wheels, a fuel tank disposed on the upper side of the engine, and a deriver's seat disposed on the rear end of the fuel tank, causes an increase in the motorcycle's engine height. This results in the fuel tank being provided in a higher position, causing the motorcycle to have a deteriorated appearance and an improper driver's position. Therefore, the motorcycle needs to reduce its engine height to a minimum.

In order to reduce the engine height, the motorcycle uses a dry sump lubrication system having a separate oil tank to which a lubricant accumulated at the bottom of a crankcase returns so that the bottom of the crankcase can be elevated to the crankshaft.

With the crankcase bottom elevated, the crankshaft rotation and piston reciprocation cause pressure variations. Therefore, the lubricant accumulated at the bottom of the crankcase is dispersed forward and rearward of the crankshaft, making it difficult to collect the lubricant. A motorcycle with a larger engine displacement shows a stronger tendency in this occuring. This prevents the motorcycle from having a larger engine displacement.

The advantage of the present invention made in view of the situation described above is to provide a lubrication system for an engine capable of reducing the engine height by elevating the crankcase bottom, as well as of reliably collecting a lubricant accumulated at the bottom of the crankcase.

SUMMARY OF THE INVENTION

According to an embodiment of the present invention, a lubrication system for an engine includes an oil tank, a crankshaft, a crankcase for housing the crankshaft, an oil sump formed at the bottom of the crankcase and collecting a lubricant for circulated moving parts to be lubricated and an oil pump for returning the lubricant collected in the oil sump to the oil tank. The oil sump and an oil suction port are provided respectively on one side and the other side of a normal plane including an axis of the crankshaft.

The oil pump is provided only on the one side, and the oil suction port provided on the other side is connected to the oil pump through a suction passage.

The present invention relates to a lubrication system for an engine, wherein the suction passage is disposed in a region offset from a crank arm in an axial direction of the crankshaft.

The present invention also relates to a lubrication system for an engine, wherein the suction passage is formed with a separate pipe member from the crankcase, and disposed outside of the crankcase.

According to the present invention, on one pump shaft of the oil pump are mounted first and second rotors for sucking a lubricant accumulated in the oil sump from the suction port, and a third rotor for delivering the lubricant in the oil tank to the moving parts to be lubricated.

The engine is designed for motorcycles, and the oil pump is provided at a forward end of a vehicle in the crankcase, and the oil tank is disposed on a body frame forward from the engine.

The engine is also designed for motorcycles, and the crankshaft is disposed in a lateral direction of a vehicle.

According to an embodiment of the present invention, the oil sump and oil suction port are disposed respectively on both sides of the crankshaft. Therefore, the lubricant can be collected reliably without accumulation even if it is dispersed towards one side and the other side of the crankshaft due to pressure variations caused by the crankshaft rotating and the piston reciprocating. As a result, the problem of accumulation of the lubricant can be resolved when the engine displacement is increased, and the bottom of the crankcase can be elevated. Accordingly, the engine height can be suppressed that much.

The oil pump is disposed only on the one side of the crankshaft, and the oil pump is connected to the oil suction port provided on the other side through the suction passage. Therefore, it is capable of sucking the lubricant from the two oil sumps by using only one oil pump. This prevents an increase in the number of parts used, and a complicated drive system of the oil pump, although two oil sumps are provided separately.

The suction passage is disposed in a region offset from the crank arm in the axial direction of the crankshaft. This allows the suction passage to be disposed closer to the crankshaft, and prevents this suction passage from interfering with the bottom of the crankcase when it is elevated towards the crankshaft.

The suction passage is also formed with a pipe member, and disposed outside of the crankcase. This provides the suction passage with a more flexible arrangement. A space for disposing the oil pump can be thus easily secured.

On one pump shaft of the oil pump are mounted the first and second rotors for sucking the lubricant from the suction port, and the third rotor for delivering the lubricant in the oil tank to the moving parts to be lubricated. Therefore, even if one oil pump is only disposed, the oil pump is allowed to act as two oil scavenging pumps and one oil feed pump, reducing the size of the oil pump to prevent an increase in size of the lubrication system, and easily securing a space for disposing the oil pump.

The oil pump is provided in the crankcase at its forward end of a vehicle, and the oil tank is disposed on a body frame forward from the engine. Therefore, the oil pump and the oil tank can be disposed close to each other when the present invention is applied to motorcycle engines, simplifying a lubrication path.

The engine is mounted with its crankshaft oriented in the lateral direction of the vehicle. Therefore, even if the lubricant is accumulated on one side (rearward) and the other side (forward) of the crankshaft due to a steep acceleration and deceleration, the lubricant can be reliably collected.

DETAILED DESCRIPTION OF THE PREFERRED EMBODIMENTS

The embodiments of the present invention will be hereinafter described in reference to the appended drawings.

Figure 1:
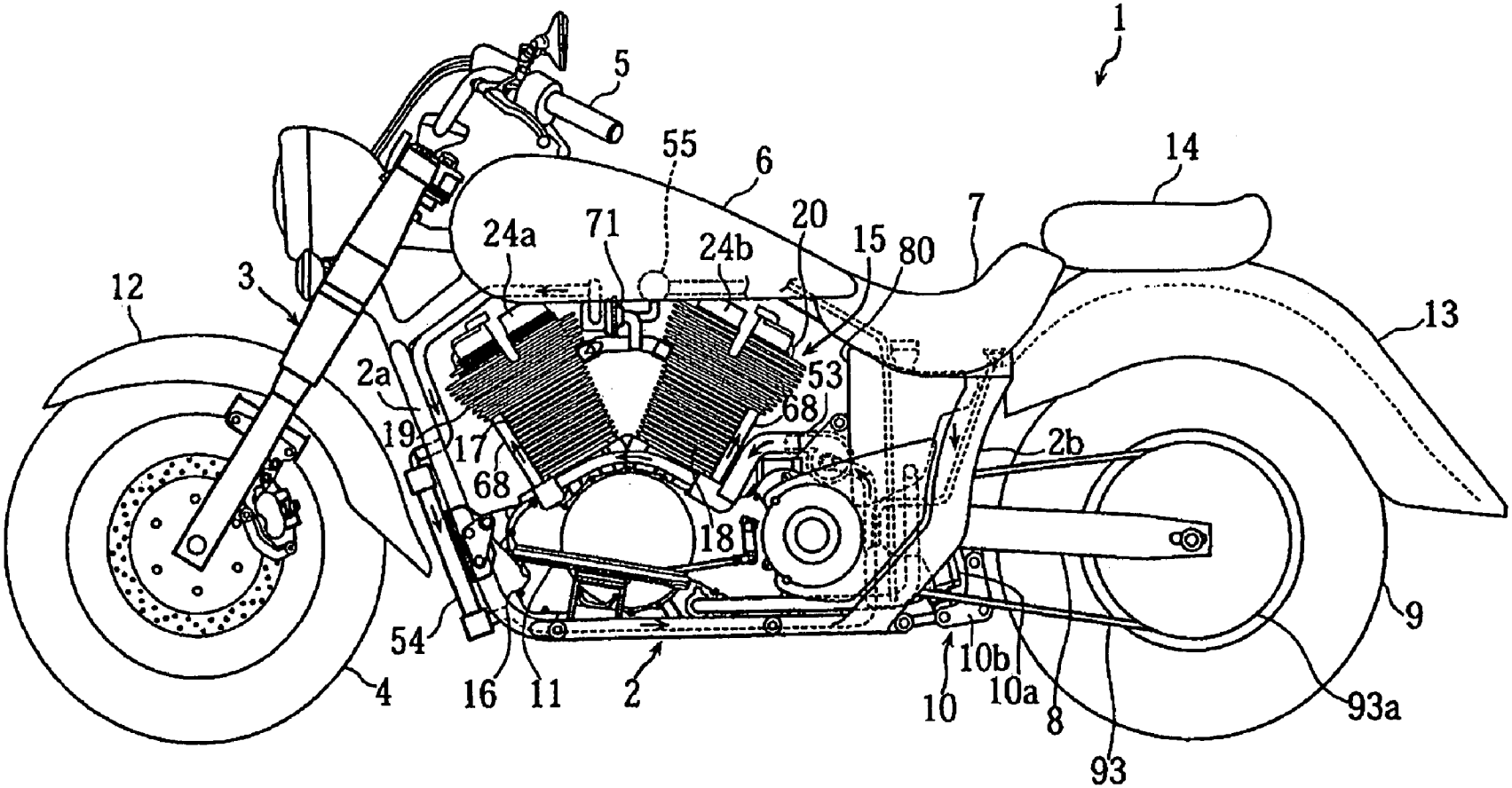
FIG. 1 is a left side view of a motorcycle carrying an engine according to an embodiment of the present invention.
Figure 2:
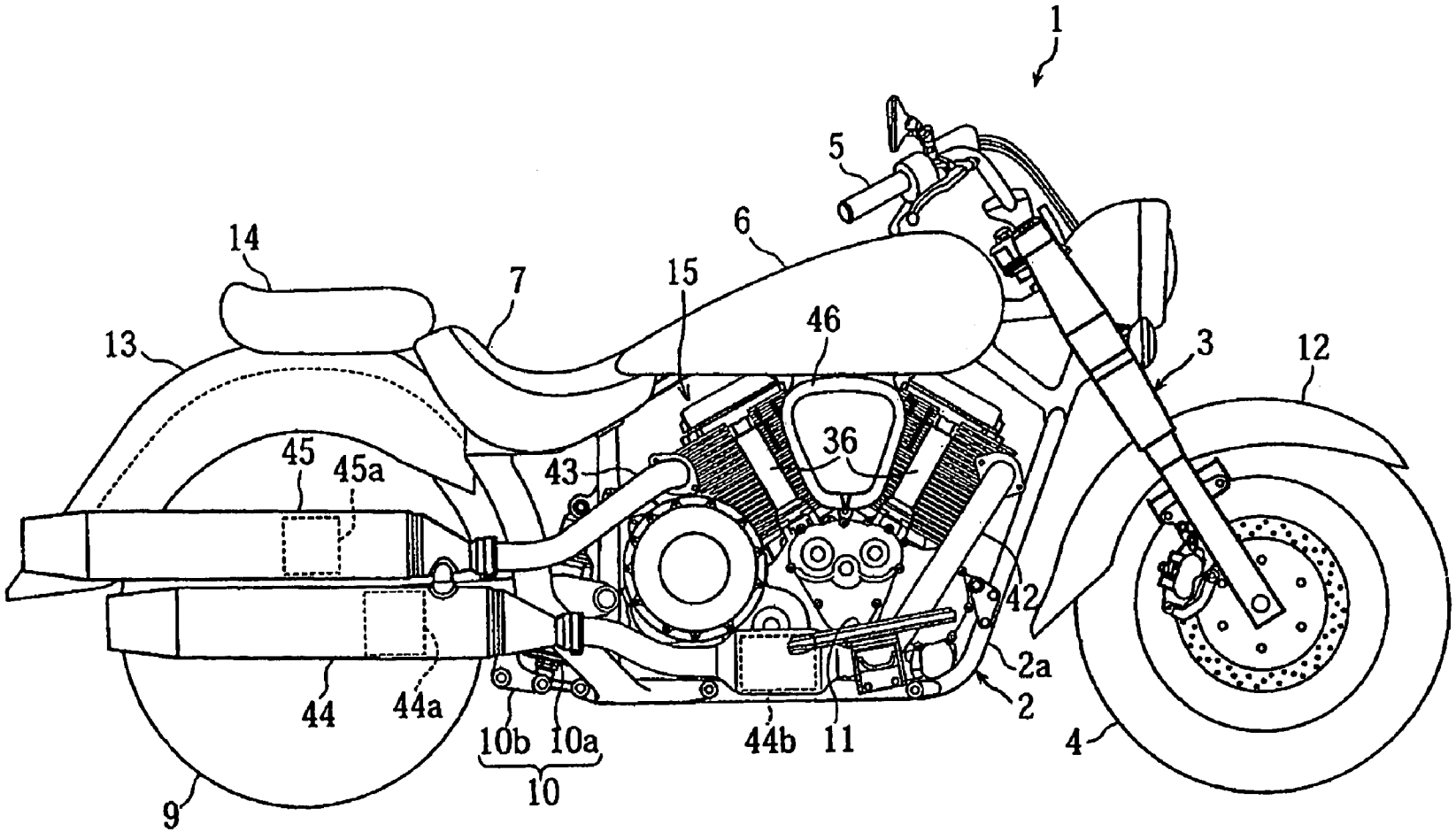
FIG. 2 is a right side view of the motorcycle.
Figure 3:
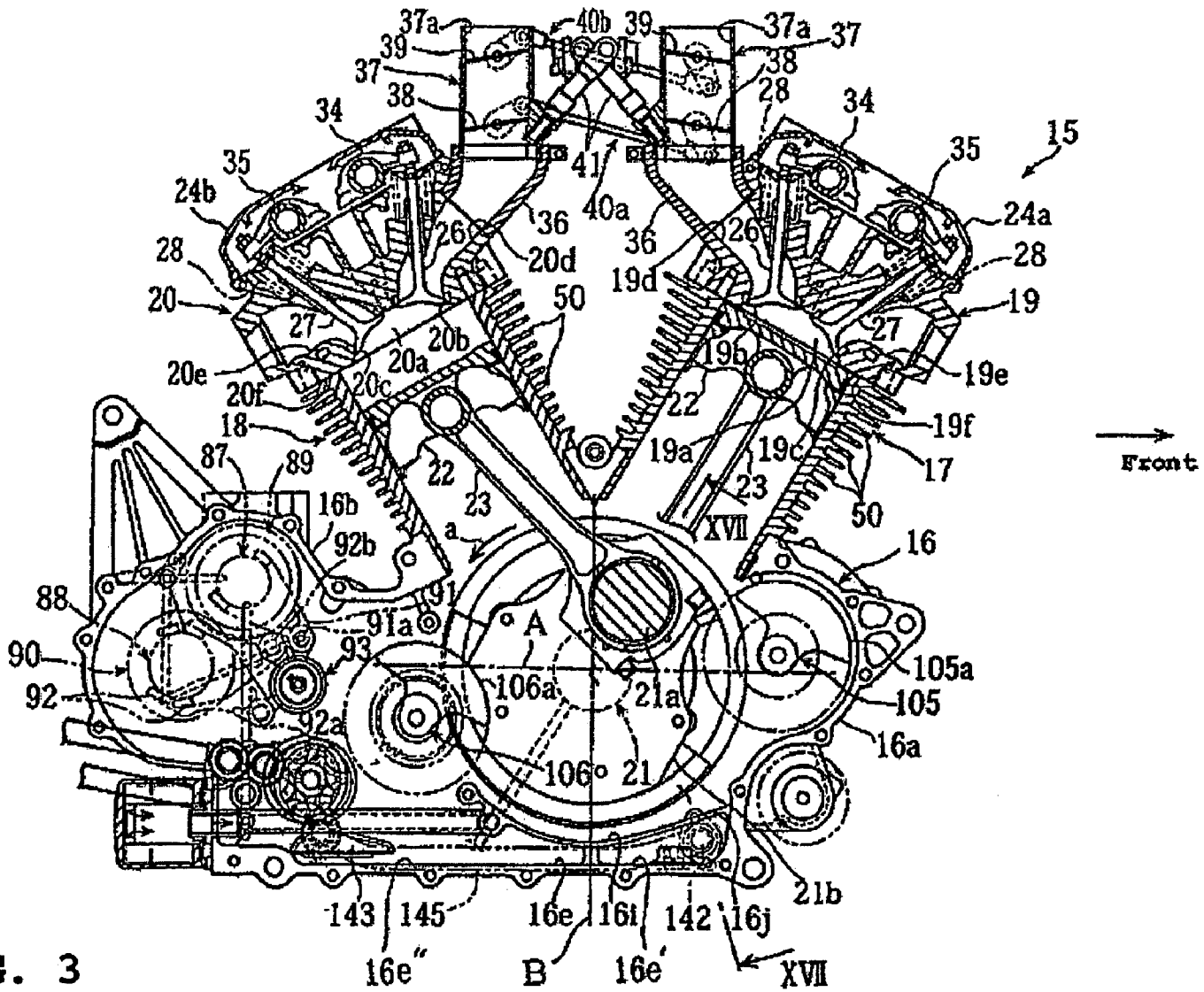
FIG. 3 is a sectional right side view of the engine.
Figure 4:
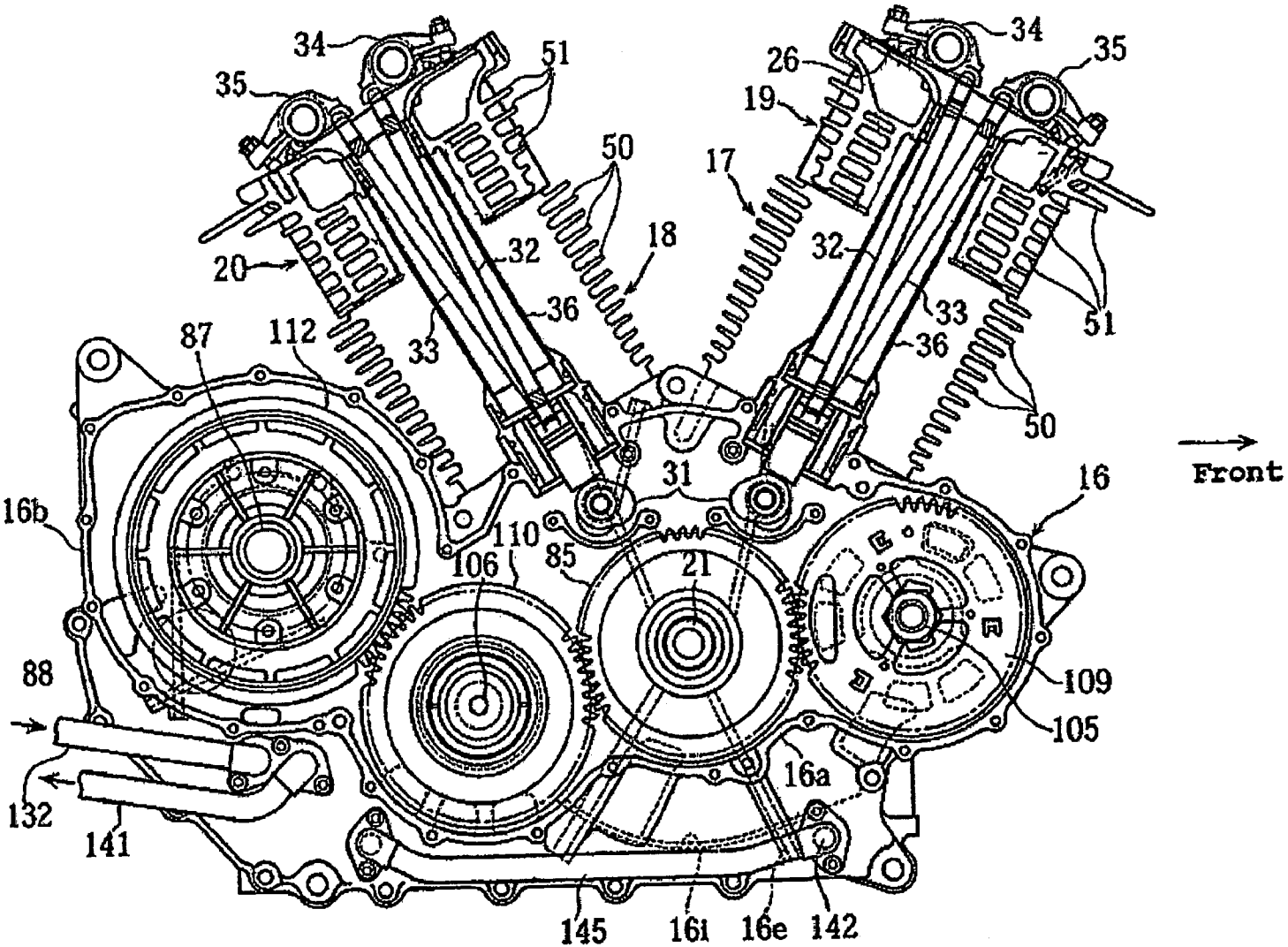
FIG. 4 is a sectional right side view of the engine.
Figure 5:
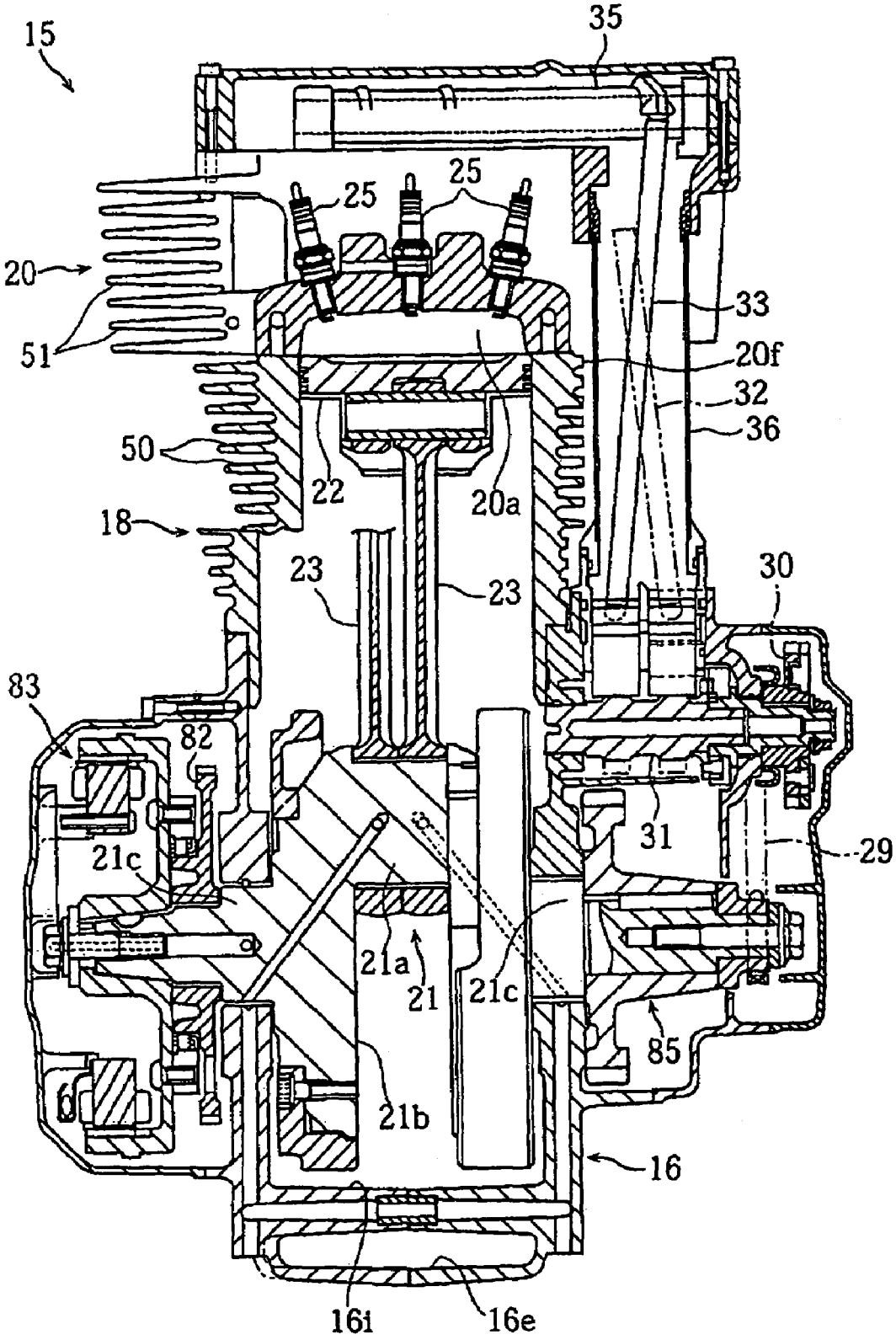
FIG. 5 is a sectional rear view of the engine.
Figure 6:
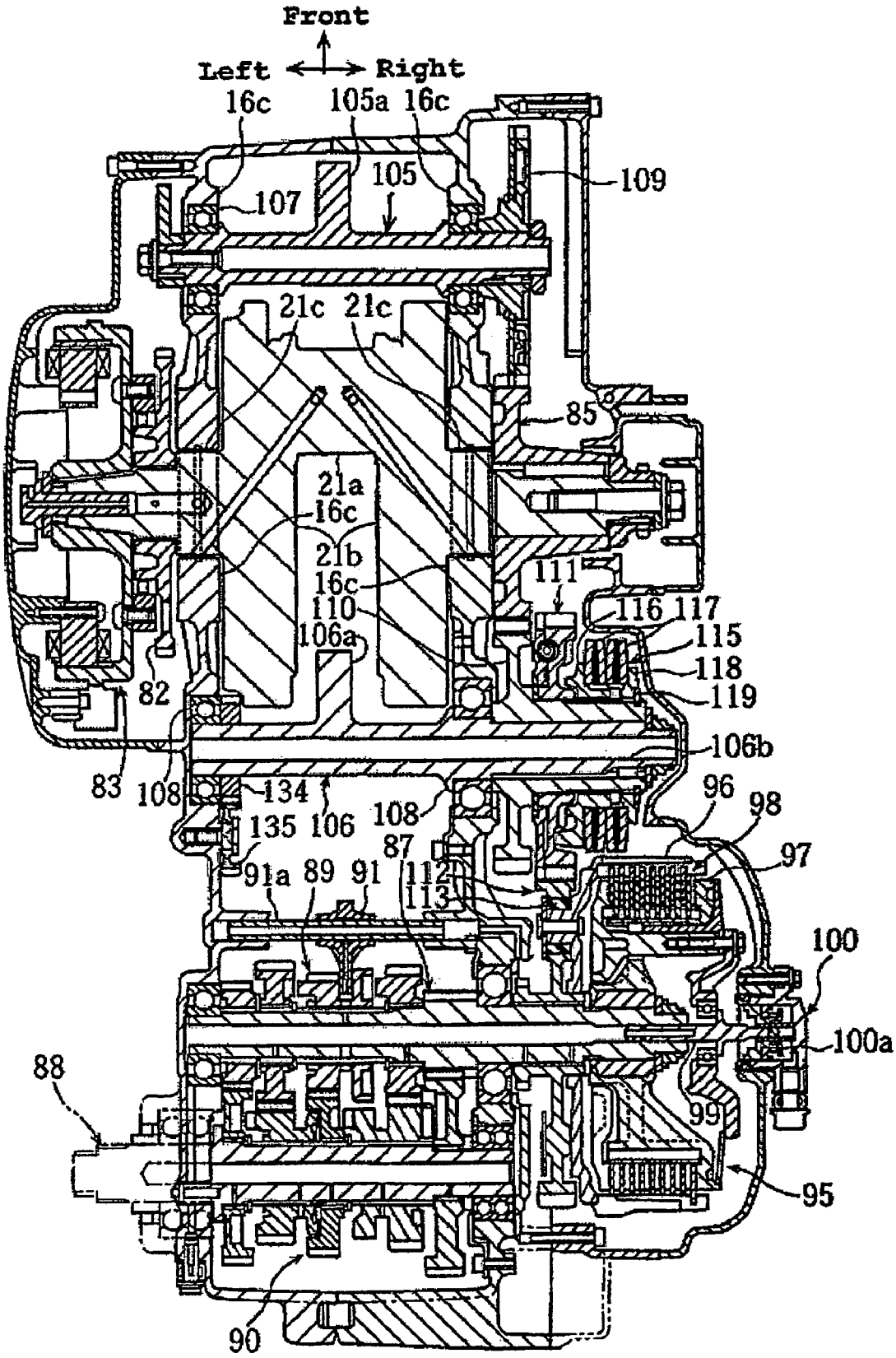
FIG. 6 is a sectional plan view of the engine.
Figure 7:
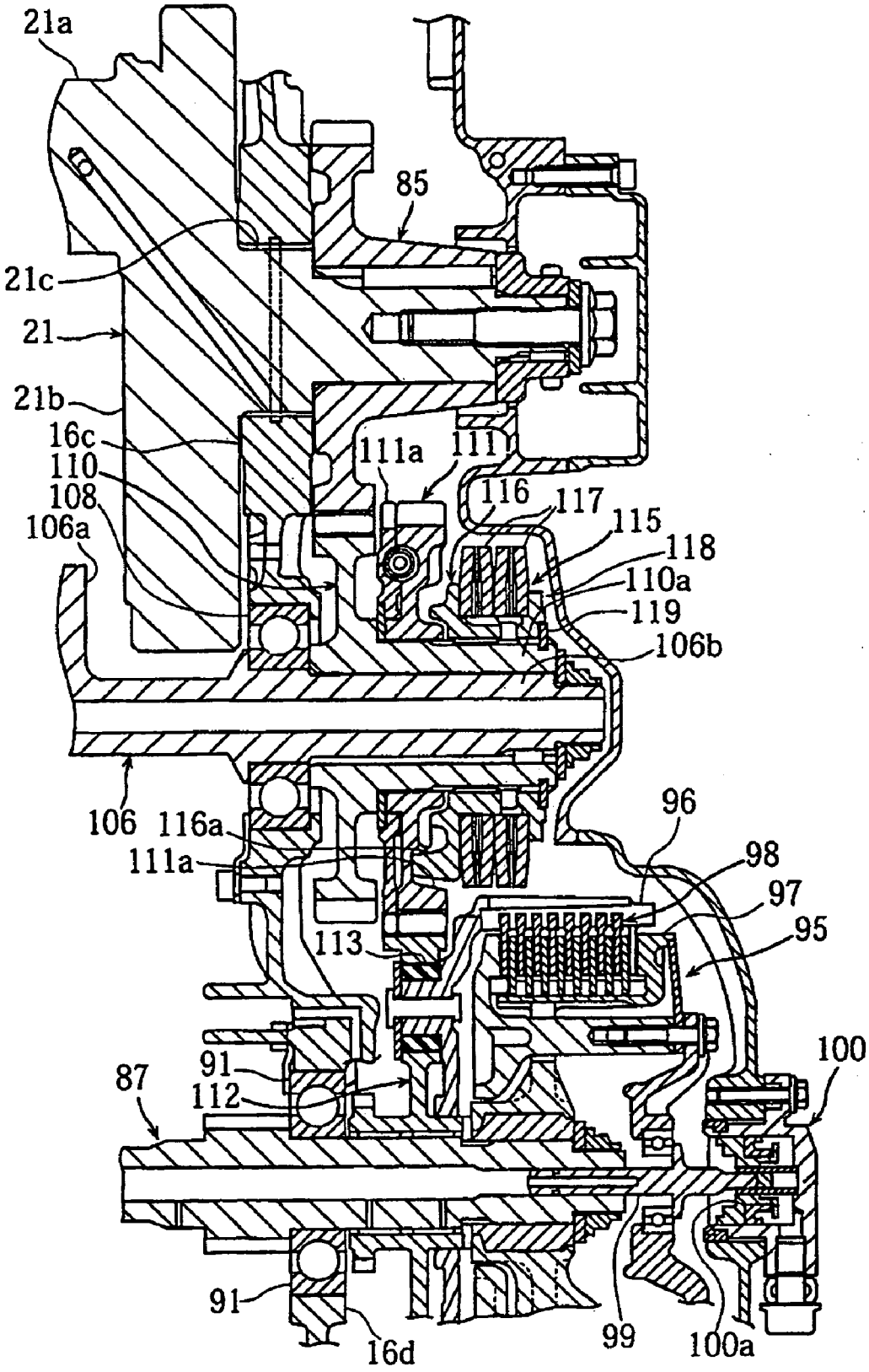
FIG. 7 is a sectional plan view of a power transmission section of the engine.
Figure 8:
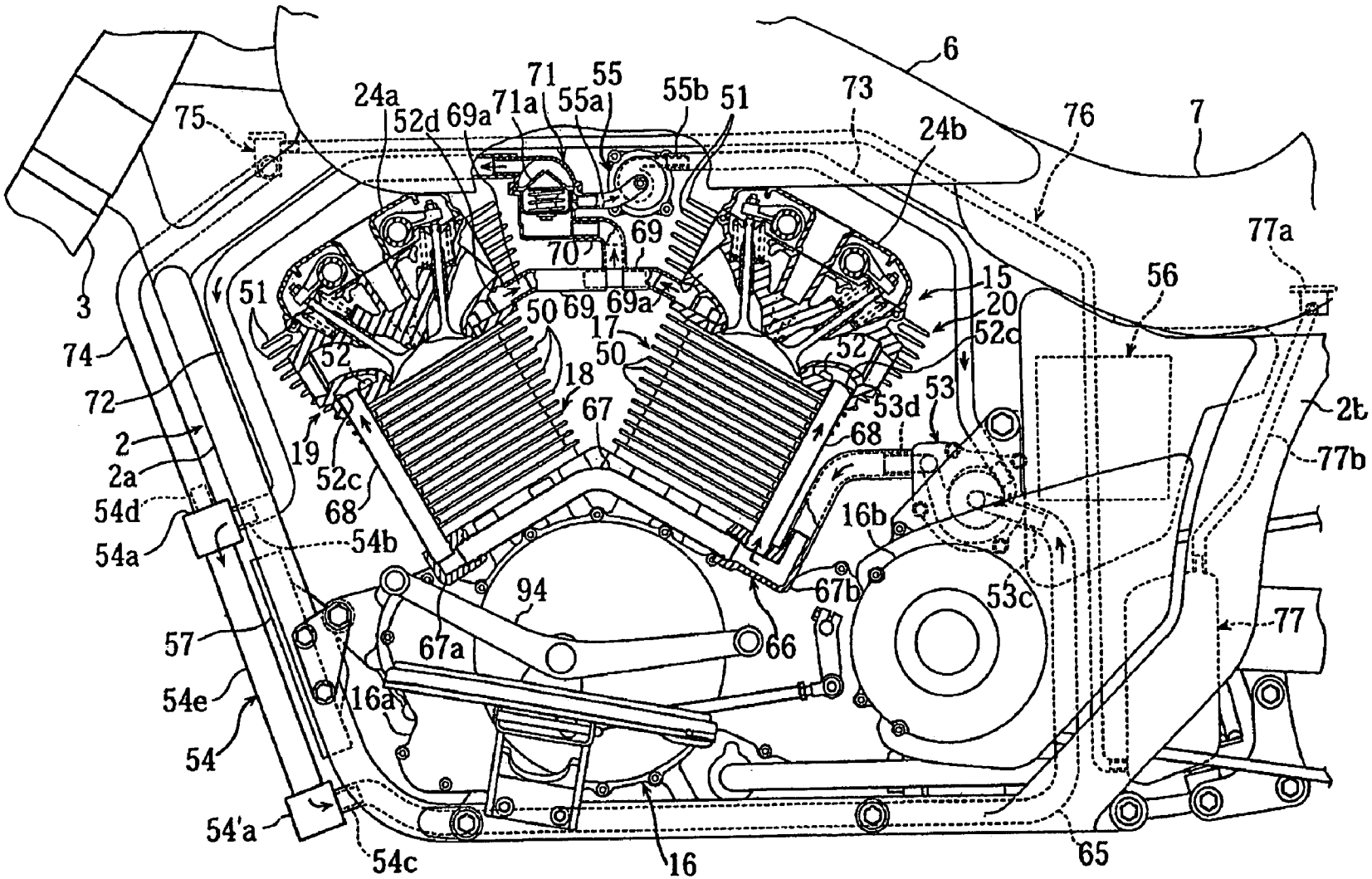
FIG. 8 is an overall view of a partial water cooling system of the engine.
Figure 9:
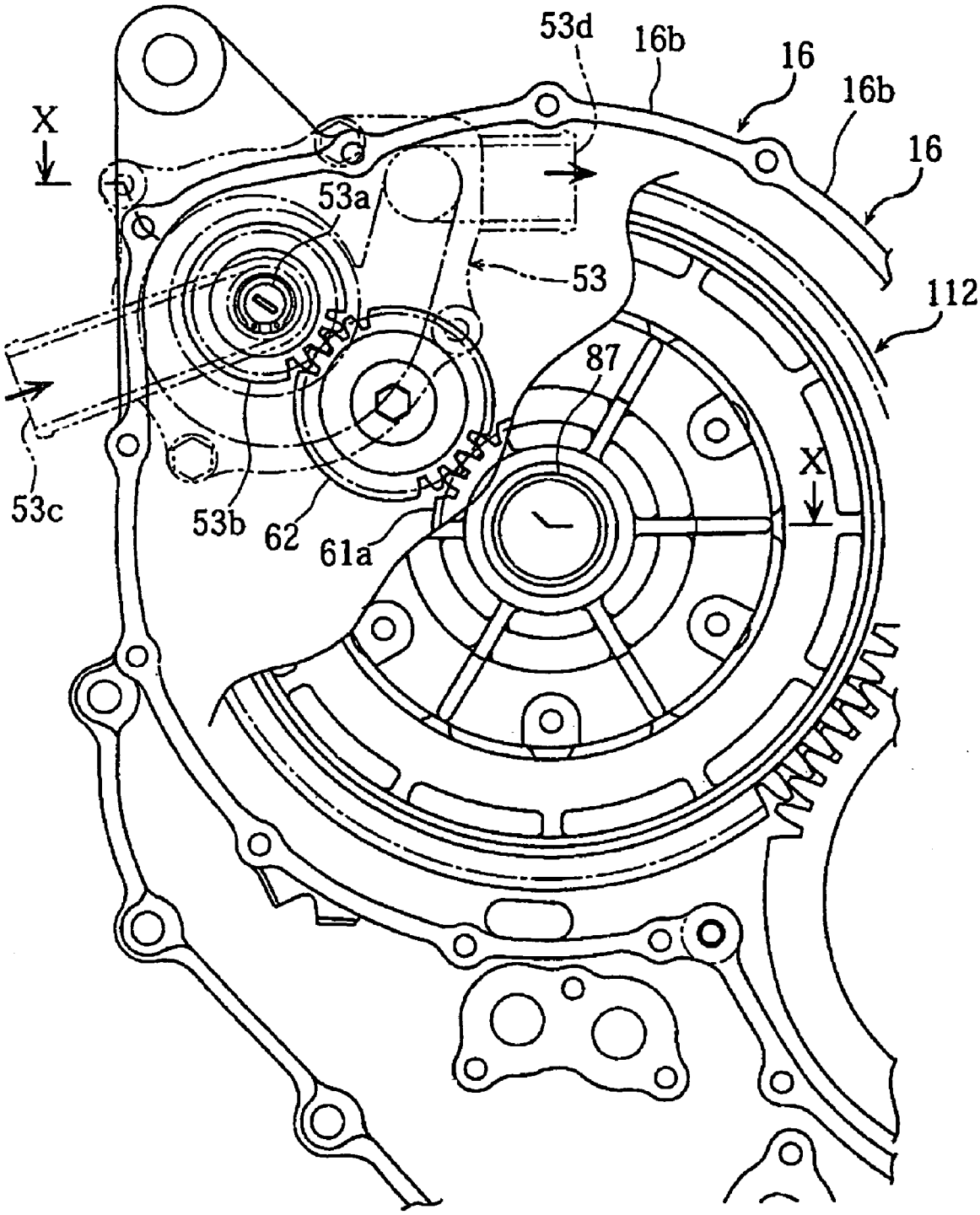
FIG. 9 is a sectional side view of a water pump section of the partial water cooling system.
Figure 10:
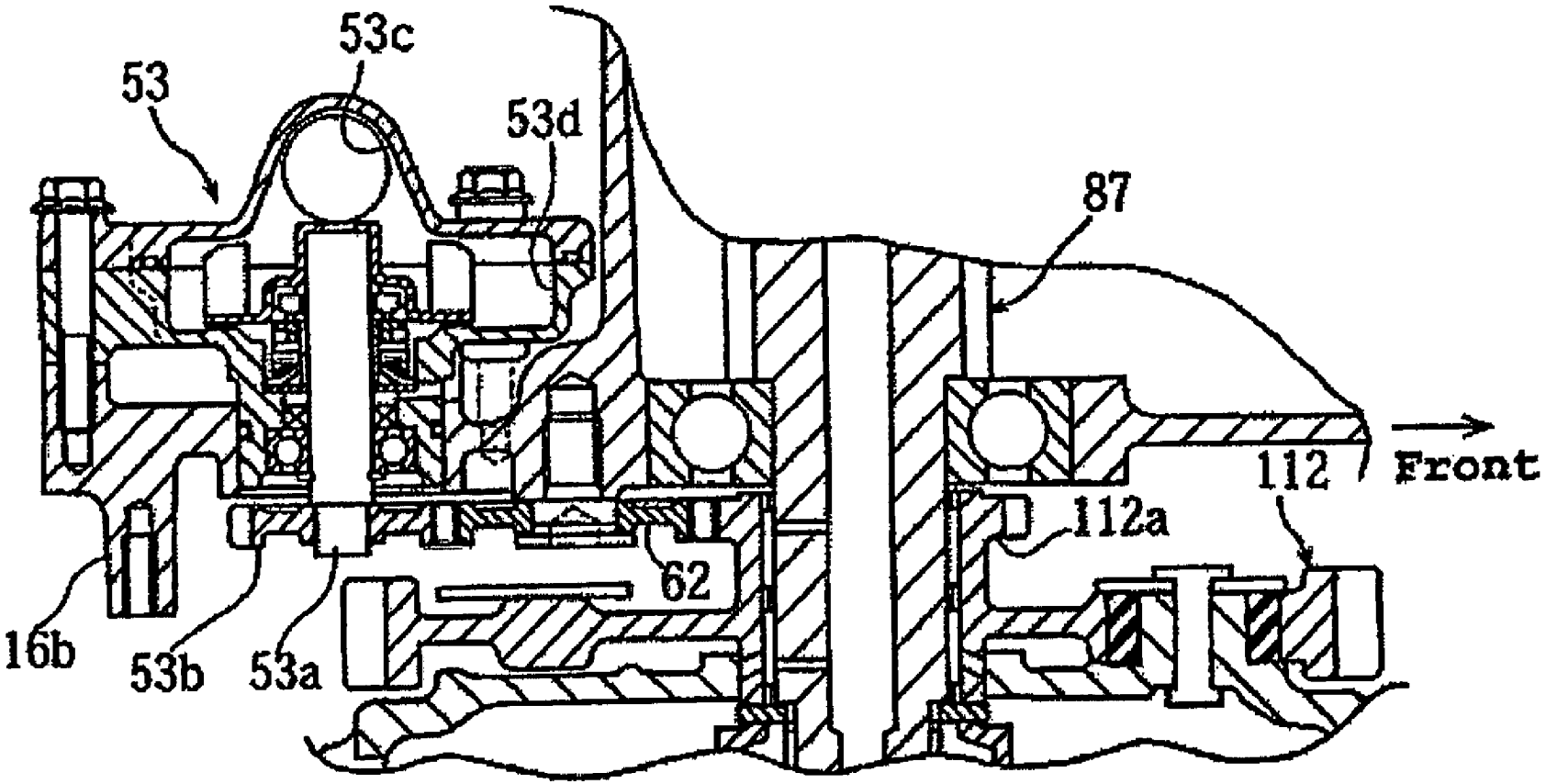
FIG. 10 is a sectional view taken along the line X—X of FIG. 9.
Figure 11:
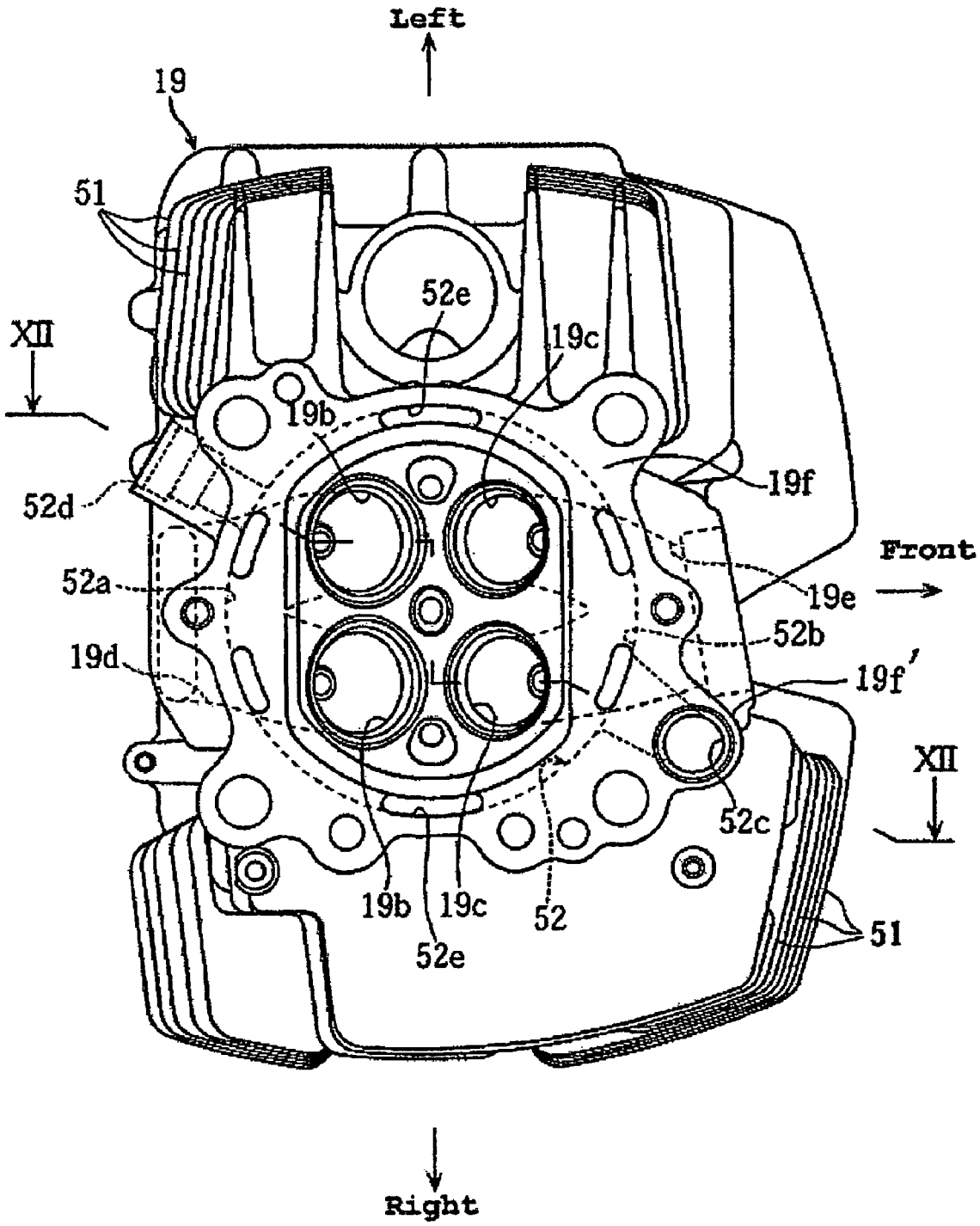
FIG. 11 is a bottom view of a cylinder head.
Figure 12:
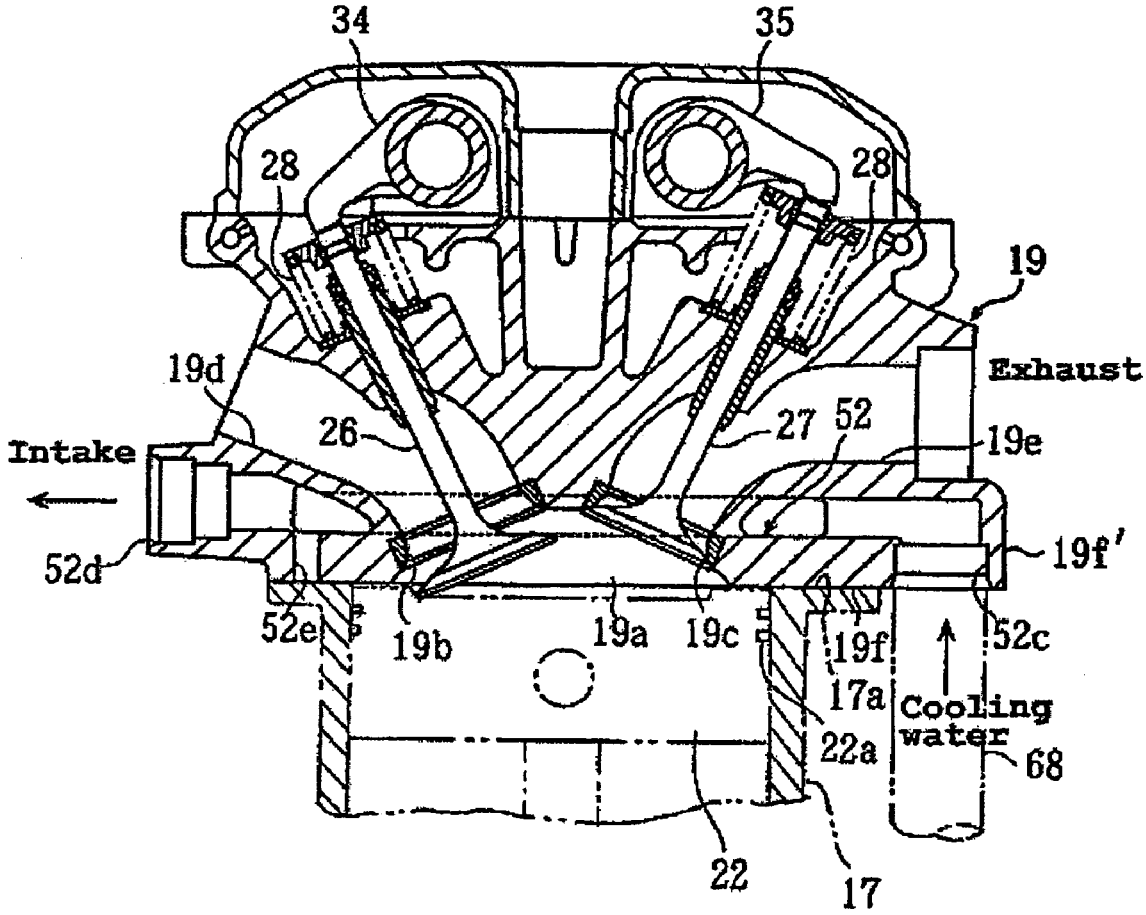
FIG. 12 is a sectional view taken along the line XII—XII of FIG. 11.
Figure 13:
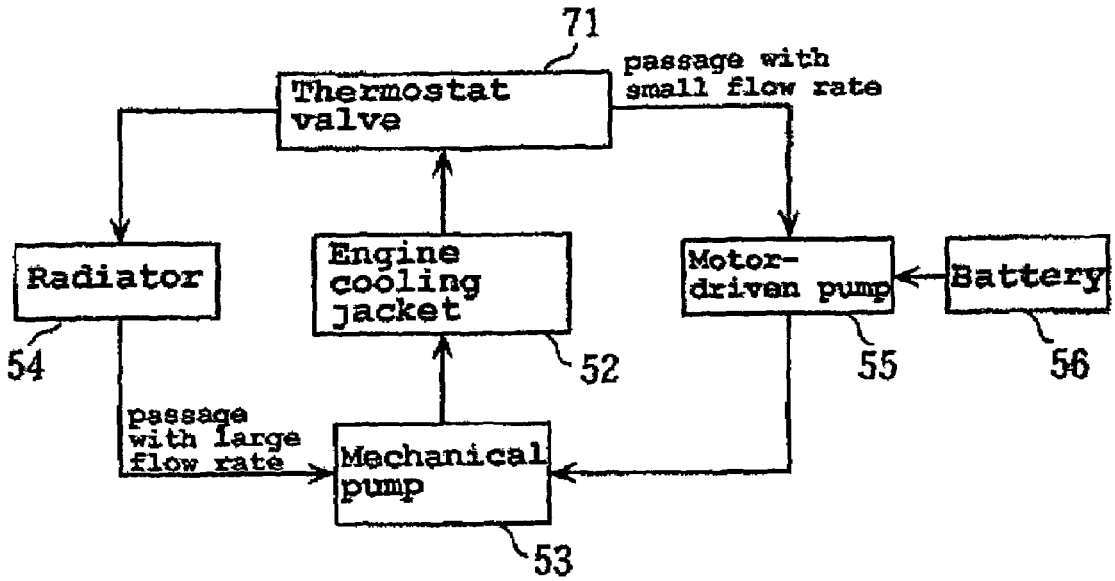
FIG. 13 is a block diagram of the partial water cooling system.
Figure 14:
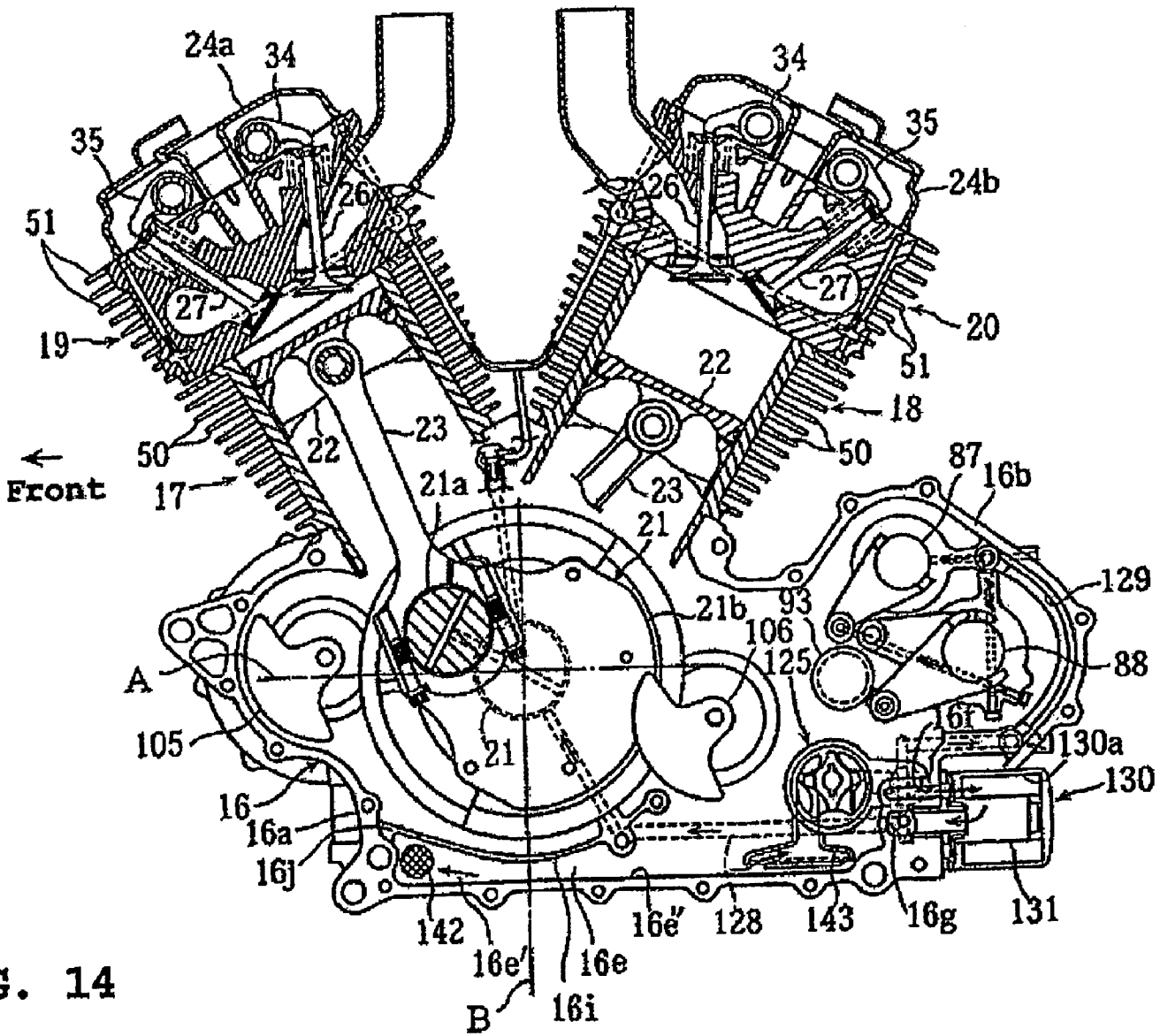
FIG. 14 is a sectional left side view showing a lubrication system of the engine.
Figure 15:
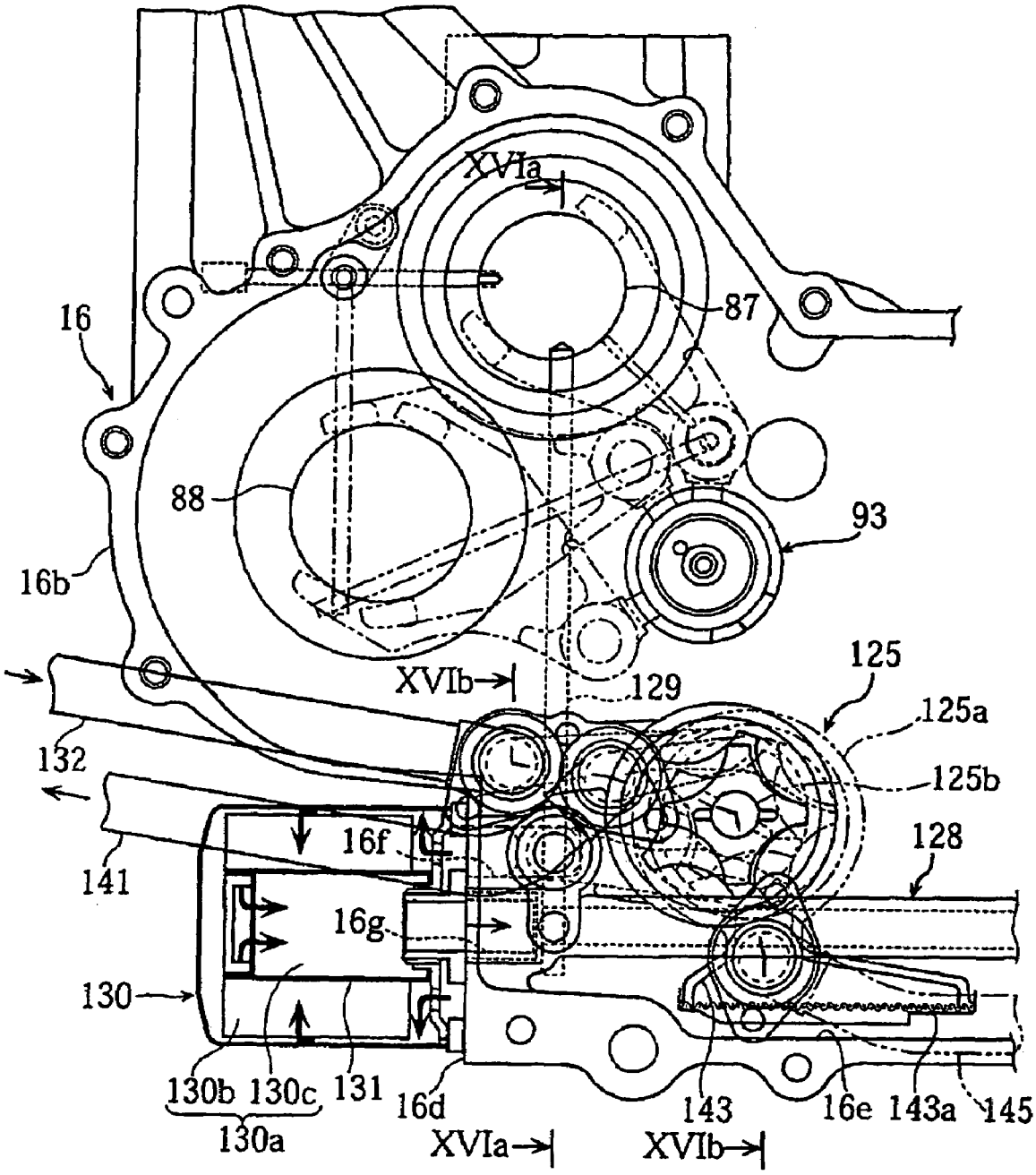
FIG. 15 is a right side view of an oil pump of the engine and its surrounding portion.
Figure 16:
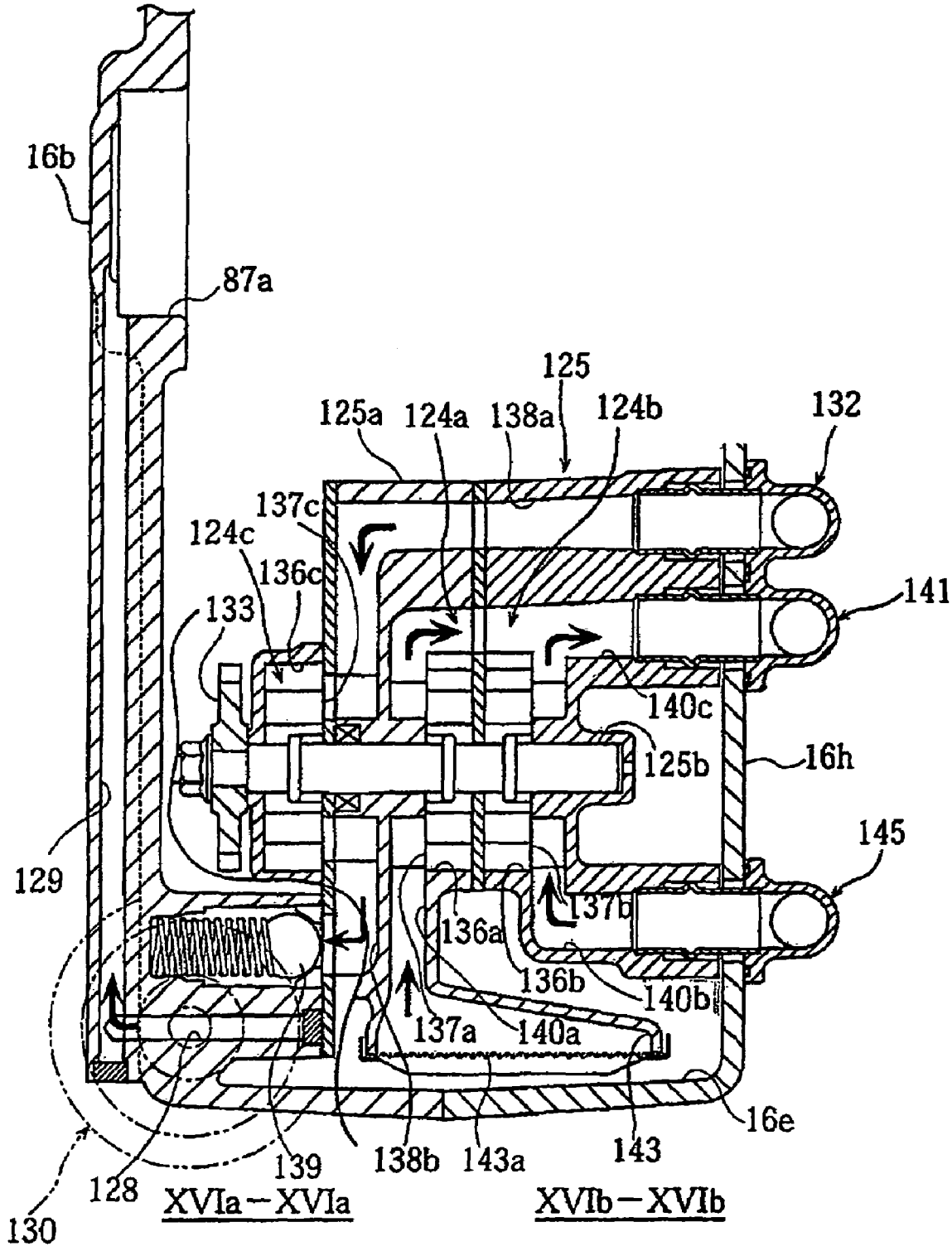
FIG. 16 is a sectional view taken along the line XVIa—XVIa and the line XVIb—XVIb of FIG. 15.
Figure 17:
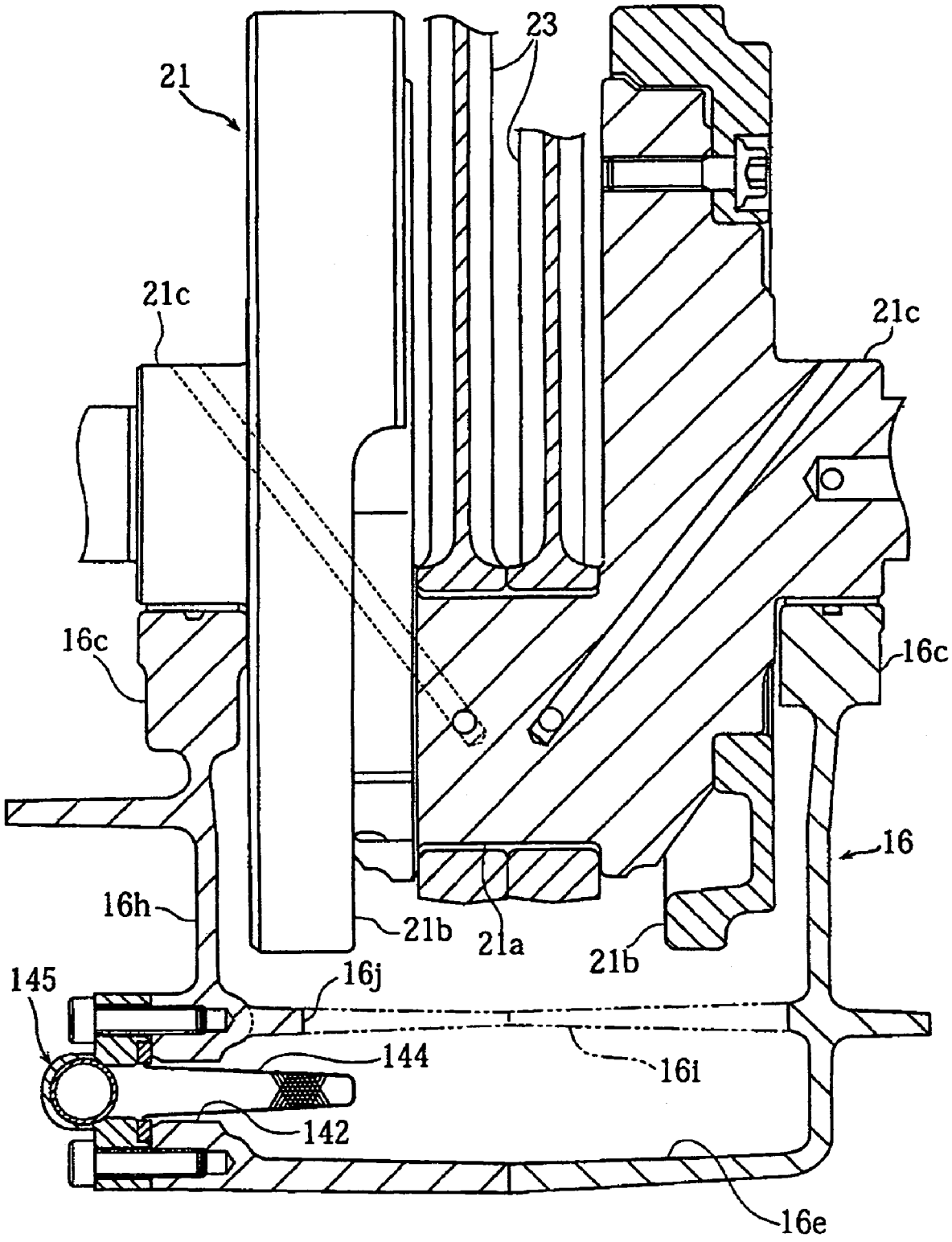
FIG. 17 is a sectional view of an oil sump section of the crankcase of the engine (sectional view taken along the line XVII—XVII of FIG. 3).
Figure 18:
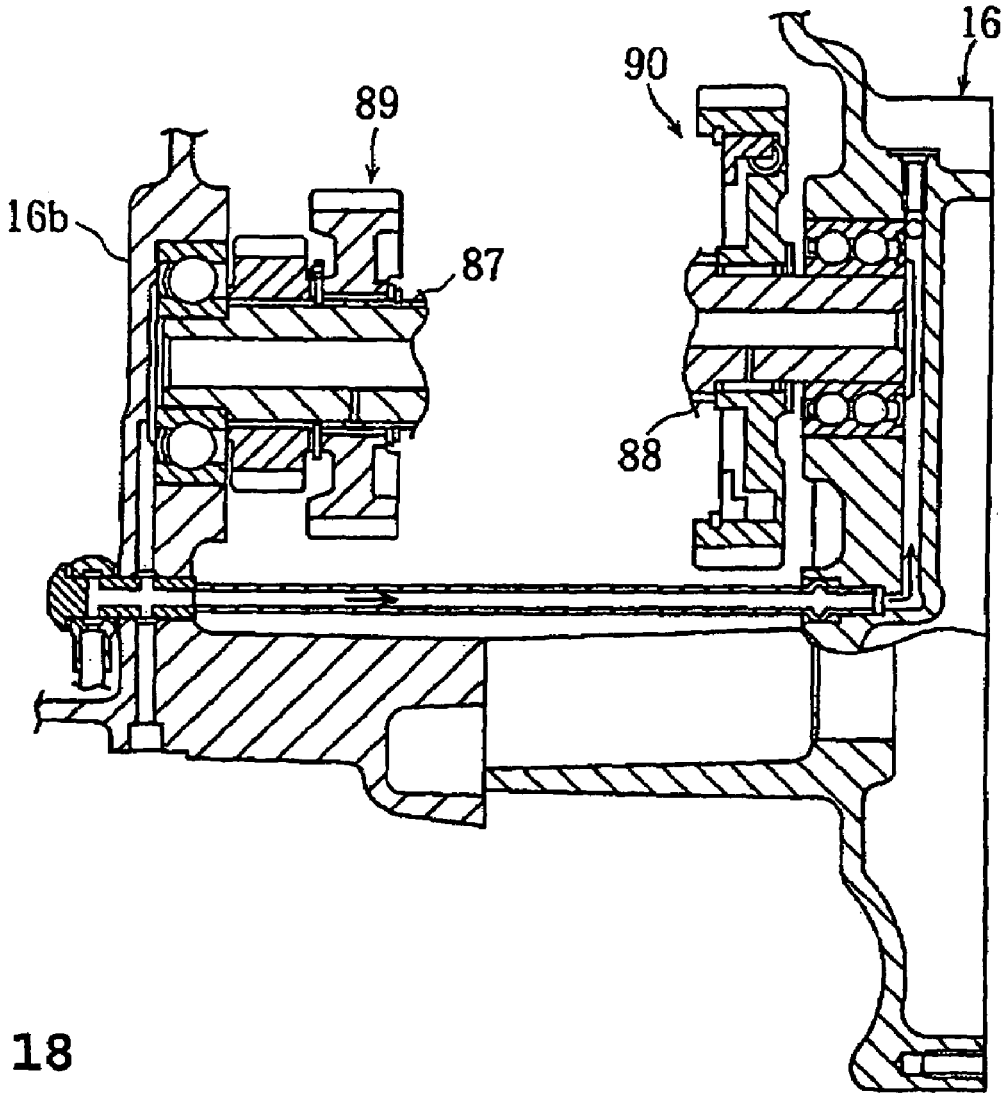
FIG. 18 is a sectional view of a lubrication path of a transmission of the engine.
Figure 19:
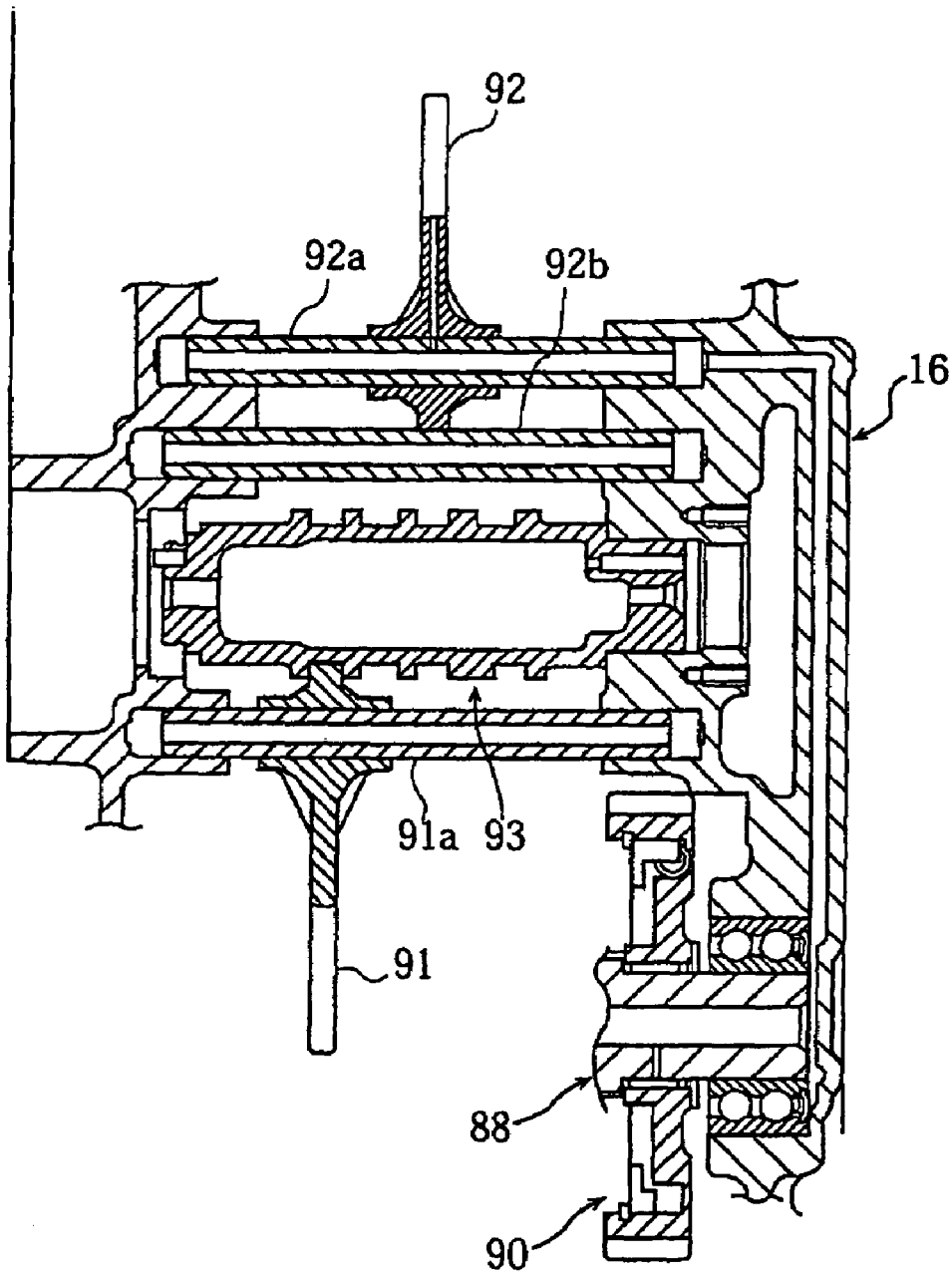
FIG. 19 is a sectional view of a lubrication path of the engine.
Figure 20:
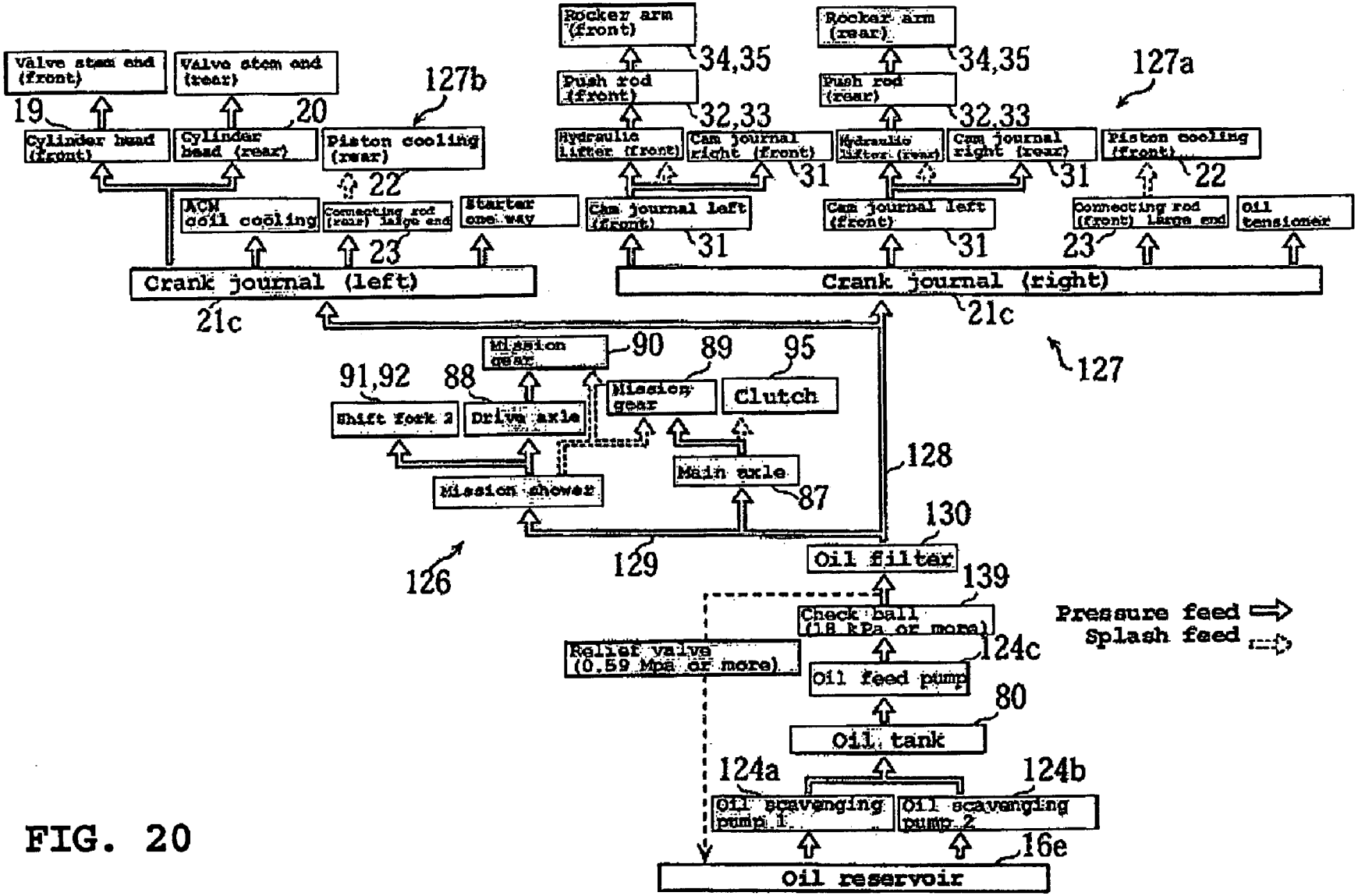
FIG. 20 is a system diagram of a lubricant path of the engine.

FIG. 1–FIG. 20 are views illustrating a lubrication system for an engine according to an embodiment of the present invention. FIG. 1 and FIG. 2 are left side and right side views, respectively, of a motorcycle carrying an engine of this embodiment. FIG. 3 and FIG. 4 are sectional right side views of the engine. FIG. 5 is a sectional rear view of the engine. FIG. 6 is a sectional plan view of the engine. FIG. 7 is a sectional plan view of a power transmission section of the engine. FIG. 8 is an overall view of a partial water cooling system of the engine. FIG. 9 is a sectional side view of a water pump section of the partial water cooling system. FIG. 10 is a sectional view taken along the line X—X of FIG. 9. FIG. 11 is a bottom view of a cylinder head. FIG. 12 is a sectional view taken along the line XII—XII of FIG. 11. FIG. 13 is a block diagram of the partial water cooling system. FIG. 14 is a sectional left side view showing a lubrication system of the engine. FIG. 15 is a sectional side view of an oil pump section of the engine. FIG. 16 is a sectional view taken along the line XVIa—XVIa and line XVIb—XVIb of FIG. 15. FIG. 17 is a sectional view of an oil sump section of the crankcase. FIG. 18 and FIG. 19 are sectional views of a transmission. FIG. 20 is a block diagram showing a lubricant path of the engine. Here, terms "front and rear" and "left and right" referred to in this embodiment means "front and rear" and "left and right" when viewed by a driver on the seat.

In these figures, reference numeral 1 designates a motorcycle of a cruiser type. In the motorcycle 1, a front fork 3 is supported by a head pipe (not shown) fixed at the front end of a body frame 2 of a double cradle type. A front wheel 4 is supported at the lower end of the front fork 3 and a steering handle 5 is disposed at the upper end. A fuel tank 6 and a seat 7 are disposed at the upper part of the body frame 2 and a rear wheel 9 is supported at the rear end of a rear arm 8 supported on a rear arm bracket 2*b* for an up and down swinging movement.

Between the rear arm 8 and the body frame 2 is disposed a rear suspension 10 made up of a shock absorber 10*a* and a link mechanism 10*b*. Foot rest boards 11 for supporting the driver's feet are disposed at the sides of left and right down tubes 2*a* of the body frame 2.

A front fender 12 for covering the upper part of the front wheel 4 is attached to the front fork 3. A rear fender 13 for covering approximately the upper half of the rear wheel 9 is attached to a rear frame (not shown) extending rearward from the upper end of the rear arm bracket 2*b*, and a rear seat 14 is disposed on the upper side of the rear fender 13.

In a cradle of the body frame 2, an engine 15 is mounted with its crankshaft oriented in the lateral direction. The engine 15 is an air-cooled, four-stroke, OHV and V-type, two-cylinder engine. A front cylinder block 17 and a rear cylinder block 18 are disposed on the upper surface of a crankcase 16, making a given angle to each other in the longitudinal direction of the vehicle, and a front cylinder head 19 and a rear cylinder head 20 are piled on the upper mating surfaces of the front and rear cylinder blocks 17, 18, respectively, for the connection with head bolts. In addition, head covers 24*a*, 24*b* are mounted on the upper mating surfaces of the cylinder heads 19, 20.

The crankcase 16 has a construction in which a crankcase section 16*a* containing a crankshaft 21, and a mission case section 16*b* containing a transmission mechanism (described later) are formed integrally. The crankshaft 21 is disposed horizontally in the lateral direction, the rotational direction of which is set to be counter-clockwise as seen from the right side (see arrow [a] in FIG. 3). The crankshaft 21 has a crank pin 21*a* common to the front and rear cylinders, left and right crank arms 21*b* as well as crank journals 21*c*.

The front and rear cylinder blocks 17, 18 have cylinder bores of a diameter over 100 mm, respectively. Pistons 22 are each inserted in the respective cylinder bores for a sliding movement and the pistons 22 are connected to a crank pin 21*a* of the crankshaft 21 common to the front and rear cylinders, through connecting rods 23.

In the lower mating surfaces (mating surfaces on the cylinder block side) 19*f*, 20*f* of the front and rear cylinder heads 19, 20, combustion recesses 19*a*, 20*a* each constituting the ceiling of the combustion chamber, respectively, are formed, facing the cylinder bores, and three ignition plugs 25 are inserted into each combustion recess 19*a*, 20*a*, at certain intervals in the lateral direction. The combustion recesses 19*a*, 20*a* are formed with two intake valve openings 19*b* and 20*b*, and two exhaust valve openings 19*c* and 20*c*, respectively.

Intake valves 26 and exhaust valves 27 are disposed in the intake valve openings 19*b*, 20*b* and in the exhaust valve openings 19*c*, 20*c*, respectively, such that they are adapted to be opened and closed, and biased towards a valve closing by coil springs 28. Regarding the intake valve 26 and the exhaust valve 27, as shown in FIG. 4 and FIG. 5, the intake side and the exhaust side push rods 32, 33 are advanced upwardly and retracted downwardly through front and rear cam shafts 31, rotated by the crankshaft 21, and the push rods 32, 33 cause the intake side and the exhaust side rocker arms 34, 35 to rock, whereby they are driven to be opened/closed. The cam shafts 31 are provided, parallel to the crankshaft 21, in the crankcase 16 and rotated by the crankshaft 21 through a chain 29, a middle shaft (not shown) and a timing gear 30.

The intake side and exhaust side push rods 32, 33 are contained in cylindrical casings 36 provided along the cylinder axes of the front and rear cylinder blocks 17, 18 and exposed to the right side.

The intake valve openings 19*b*, 20*b* of the front and rear cylinder heads 19, 20 are led out to the inside wall of the V-bank through each joined flow intake port 19*d*, 20*d*. To the front and rear intake ports 19*d*, 20*d* are connected throttle bodies 37 through front and rear intake pipes 36 with their axes oriented approximately vertically, and to an air inlet 37*a* of each throttle body 37 is connected a common air cleaner 46.

A main throttle valve 38 is provided on the downstream side of the throttle body 37 and a sub-throttle valve 39 on the upstream side. Valve shafts of the front and rear main throttle valves 38 are connected to each other and those of the sub-throttle valves 39 are connected to each other through link mechanisms 40*a*, 40*b*, respectively.

Fuel injection valves 41 are mounted to the front and rear throttle bodies 37 on the downstream side from the throttle valves 38, respectively, and the injection head of the fuel injection valve 41 is disposed such that fuel is injected towards the back of the intake valve 26.

The exhaust valve openings 19*c*, 20*c* of the front and rear cylinder heads 19, 20 are led out to the outside wall of the V-bank through joined flow intake ports 19*e*, 20*e*. To the front and rear exhaust ports 19*e*, 20*e* are connected front and rear exhaust pipes 42, 43, as shown in FIG. 2. The exhaust pipes 42, 43 extend rearward on the right side of the body and to the downstream ends of the exhaust pipes are connected front and rear mufflers 44, 45 provided at the right side of the rear wheel 9.

Catalysts 44*a*, 45*a* for purifying exhaust gas are provided in the front and rear mufflers 44, 45, respectively. An auxiliary catalyst 44*b* is provided in the middle of the front exhaust pipe 42. Since the front exhaust pipe 42 has the length larger than that of the rear exhaust pipe 43, activation of the catalyst 44*a* is apt to be delayed during warming up of the engine. Therefore, the auxiliary catalyst 44*b* is provided in the front exhaust pipe 42 to accelerate exhaust gas purification during warming up.

Now, the cooling structure of the air-cooled engine 15 will be described with reference mainly to FIG. 8–FIG. 13.

Numerous cooling fins 50, 51 are formed integrally on the outside walls of the front and rear cylinder blocks 17, 18 and front and rear cylinder heads 19, 20, at approximately right angles to the axes of the bores. The running wind blows directly on the cylinder blocks 17, 18 and cylinder heads 19, 20, so that heat from the engine is released through the cooling fins 50, 51 for the cooling of the engine 15.

The air-cooled engine 15, while mainly utilizing air-cooling by the wind, is provided with a partial water cooling system operated with cooling water, the construction of which is described below. The same cooling structures are used both in the front side and the rear side cylinder, and description will be made for the front side cylinder.

In this embodiment, a cooling jacket is formed only between a virtual surface of approximately a truncated conical shape generated by a bottom line of the intake port 19*d* or exhaust port 19*e* being rotated about the cylinder axis, which bottom line appearing when the front cylinder head 19 is cut by a plane including the cylinder axis and perpendicular to the crankshaft 21, and a plane including a piston ring 22*a* in the lower end of the piston 22 positioned at the top dead center.

More specifically, the front cylinder head 19 is formed with an annular cooling jacket 52, of about 60 cc in volume, surrounding the peripheral portion of the combustion recess 19*a* and passing through the cylinder head 19 between the intake and exhaust ports 19*d*, 19*e* and lower mating surface 19*f*. A portion between intake valves 52*a* of the cooling jacket 52 corresponding in position to the region between the intake valve openings 19*b* and a portion between exhaust valves 52*b* corresponding in position to the region between the exhaust valve openings 19*c* have larger passage areas than the other.

In the lower mating surface 19*f* of the front cylinder head 19 at the exhaust port 19*e* side is formed an overhang portion 19*f* overhanging outward from the mating surface 17*a* of the cylinder block 17. In the overhang portion 19*f*, a cooling water supply port 52*c* is formed therethrough for communication with the cooling jacket 52. Also, a cooling water discharge port 52*d* in communication with the cooling jacket 52 is open at the inside wall of the V-bank of the front cylinder head 19 below the intake port 19*d*. The cooling water discharge port 52*d* is located higher than the cooling water supply port 52*c*, which prevents generation of air pockets in the cooling jacket 52. Reference numeral 52*e* designates a hole used for removing core sand when the cooling jacket 52 is casted, which is closed by a gasket placed between the cylinder block and cylinder head. Cooling water supplied from the cooling water supply port 52*c* first cools the region around the exhaust port 19*e* at the highest temperature and flows towards the intake port 19*d* to be discharged from the cooling water discharge port 52*d*.

The partial water cooling system is provided with a mechanical pump 53 driven for rotation by the crankshaft 21, a radiator 54 for cooling the cooling water supplied to the cooling jacket 52 with cooling water, and a motor-driven pump 55 for circulating the cooling water in the cooling jacket 52 for a given time such that the cooling water bypasses the radiator 54 when stoppage of the engine 15 causes the mechanical pump 53 to stop.

The radiator 54 is provided in front of and at the lower ends of the vertical portions of the left and right down tubes 2*a* of the body frame 2, and a cooling fan 57 is disposed behind the radiator 54 such that it is located between the left and right vertical portions. The radiator 54 includes upper and lower headers 54*a*, 54*a*' connected by an element 54*e*, having radiating fins a cooling water inlet 54*b* formed in the back of the upper header 54*a*, a cooling water outlet 54*c* in the back of the lower header 54*a*' and a cooling water filler port 54*d* formed at the top of the upper header 54*a*. The radiator 54 is disposed such that the upper header (upper end portion) 54*a* is positioned at approximately the same height as the lower end of the front cylinder block 17 when viewed from the front of the vehicle.

The mechanical pump 53 is disposed upward of a main shaft 87 (described later) provided in the mission case section 16*b*, with the pump shaft 53*a* oriented in the direction parallel to the main shaft 87. A pump gear 53*b* fixed to the pump shaft 53*a* is meshed, through a middle gear 62, with a drive gear 112*a* formed integral with a large reduction gear 112 mounted on the main shaft 87 for relative rotation. This allows the mechanical pump 53 to be driven for rotation at all times by the crankshaft 21 during engine operation.

The cooling water outlet 54*c* of the radiator 54 is connected to a cooling water suction port 53*c* of the mechanical pump 53 by a cooling hose 65. The cooling hose 65 is laid along the horizontal portion of the down tube 2*a* at the inner side.

A supply pipe 66 is connected to a delivery port 53*d* of the mechanical pump 53. The supply pipe 66 includes a main supply pipe 67 in the shape of the letter C laid along the left upper wall of the crankcase 16 and front and rear branch pipes 68 connected to the base and the leading end of the main supply pipe 67 through joints 67*a*, 67*b* and rising along the cylinder axes of the front and rear cylinder blocks 17, 18. The upper ends of the branch pipes 68 are connected to the cooling water supply ports 52*c* of the cylinder blocks 17, 18, respectively. The front and rear branch pipes 68 are disposed such that parts of the pipes are buried in recesses formed on the cylinder blocks 17, 18 with cooling fins 50 being cut out and the remaining parts exposed to the outside, to be copied by the wind.

To the cooling water discharge ports 52*d* of the front and rear cylinder heads 19, 20 are connected discharge pipes 69 through joints 69*a*, respectively, and to the exhaust pipes 69 is connected one joined pipe 70. An exhaust hose 72 is connected to the joined flow pipe 70 through a thermostat 71, and the downstream end of the exhaust hose 72 is connected to the cooling water inlet 54*b* of the radiator 54. The thermostat 71 is disposed under the fuel tank 6 in the V-bank and adapted to establish communication between the joined flow pipe 70 and exhaust hose 72 when the temperature of cooling water reaches a setting value and an opening/closing valve 71*a* is opened.

The motor-driven pump 55 is disposed in the vicinity of and parallel to the thermostat 71 and provided with an electric motor (not shown) drive-controlled by a controller (not shown) using a battery 56, disposed below the seat 7, as a power source. A suction port 55*a* of the motor-driven pump 55 is connected to the upstream side of the opening/closing valve 71*a* of the thermostat 71. A delivery port 55*b* is connected to the suction port 53*c* of the water pump 53 through a circulation pipe 73.

To the cooling water filler port 54*d* of the radiator 54 is connected a filler hose 74 and to the filler hose 74 is connected a filler cap 75 provided in a gusset in front of the fuel tank 6. To the filler cap 75 is connected a recovery hose 76 and the recovery hose 76 is connected to the bottom of a recovery tank 77 provided under the battery 56.

To the recovery tank 77 is connected a recovery filler port 77*a* provided under the seat 7, through a filler hose 77*b*.

The partial water cooling system of this embodiment is operated as follows. When a main switch (not shown) is turned on and the engine 15 is started, the crankshaft 21 rotates, causing the mechanical pump 53 to rotate. When the temperature of the cooling water in the cooling jacket 52, in the thermostat 71, to be exact, exceeds a given value, the thermostat 71 is opened and the cooling water is circulated between the cooling jacket 52 and radiator 54.

When the main switch is turned off, the engine 15 stops, causing the mechanical pump 53 to stop. Then, the motor-driven pump 55 is started by the battery 56, the cooling water in the cooling jacket 52 is circulated through the discharge pipe 69, joined flow pipe 70, circulation pipe 73 and supply pipe 66. The radiator 54 is bypassed and the motor is stopped after a lapse of a given time (see FIG. 8 and FIG. 13)

In the cooling structure of this embodiment, the annular cooling jacket 52 is formed in the shape of a passage passing through the front and rear cylinder heads 19, 20 between the intake ports 19*d*, 20*d* as well as exhaust ports 19*e*, 20*e*, and the lower mating surfaces 19*f*, 20*f*, and surrounding the peripheral portions of the combustion recesses 19*a*, 20*a*, for the circulation of cooling water between the cooling jacket 52 and radiator 54. Therefore, the region around the combustion recesses 19*a*, 20*a* subjected to a particularly high heat load can be partially cooled with the cooling water, thereby securing engine cooling performance necessary to an air-cooled engine of a large displacement, whose bore diameter exceeds 100 mm.

The cooling jacket 52 is formed only in the peripheral portions of the combustion recesses 19*a*, 20*a*, so that cooling water capacity can be decreased to a value as small as 60 cc and the size reduction and the weight saving of the radiator 54 and mechanical pump 53 can be effected that much. As a result, the size increase as well as the weight increase of the engine due to the additional partial water cooling system can be suppressed and the degree of freedom in designing of the engine and body can be secured.

In this embodiment, a structure is adopted in which the partial water cooling system is provided with the mechanical pump 53 driven for rotation by the engine 15 and the motor-driven pump 55 for circulating cooling water in the cooling jacket for a given time when stoppage of the engine causes the mechanical pump 53 to stop. Therefore, the cooling performance required in a high speed and high load operating range can be secured with a small amount of cooling water while preventing boiling of the cooling water at the time the engine stops.

It may be possible that circulation of the cooling water while the engine operates and the engine stops is performed entirely by the motor-driven pump 55. In this case, however, it is necessary for the motor-driven pump to provide a required amount of cooling water circulation in a high speed and high load operating range of the engine, resulting in a large and heavy electric motor.

The function required by the motor-driven pump 55 in this embodiment is satisfied if only cooling water in the cooling jacket 52 is circulated for a certain time when the engine stops, so that a small pump of a small capacity can be of use. In addition, since in this embodiment, the motor-driven pump 55 is utilized as an auxiliary and arranged such that it bypasses the radiator 54, it doesn't act as a water flow resistance in the main path. Further, no large flow rate is required for the passage related to the motor-driven pump, so that the diameter of the passage can be decreased and the cooling water rarely flows to the motor-driven pump as a bypass during the normal operation of the engine.

The electric motor 35 can be placed, directly or through a bypass, in the middle of the main path passing through the radiator 54.

Further, in this embodiment, the radiator 54 is disposed in front of the left and right down tubes 2*a* of the body frame 2 such that the upper header 54*a* of the radiator 54 is positioned at a height corresponding to the lower end of the cylinder block 18. Therefore, the blocking of the wind to the engine 15 by the radiator 54 can be prevented, securing air-cooling performance.

Figure 21:
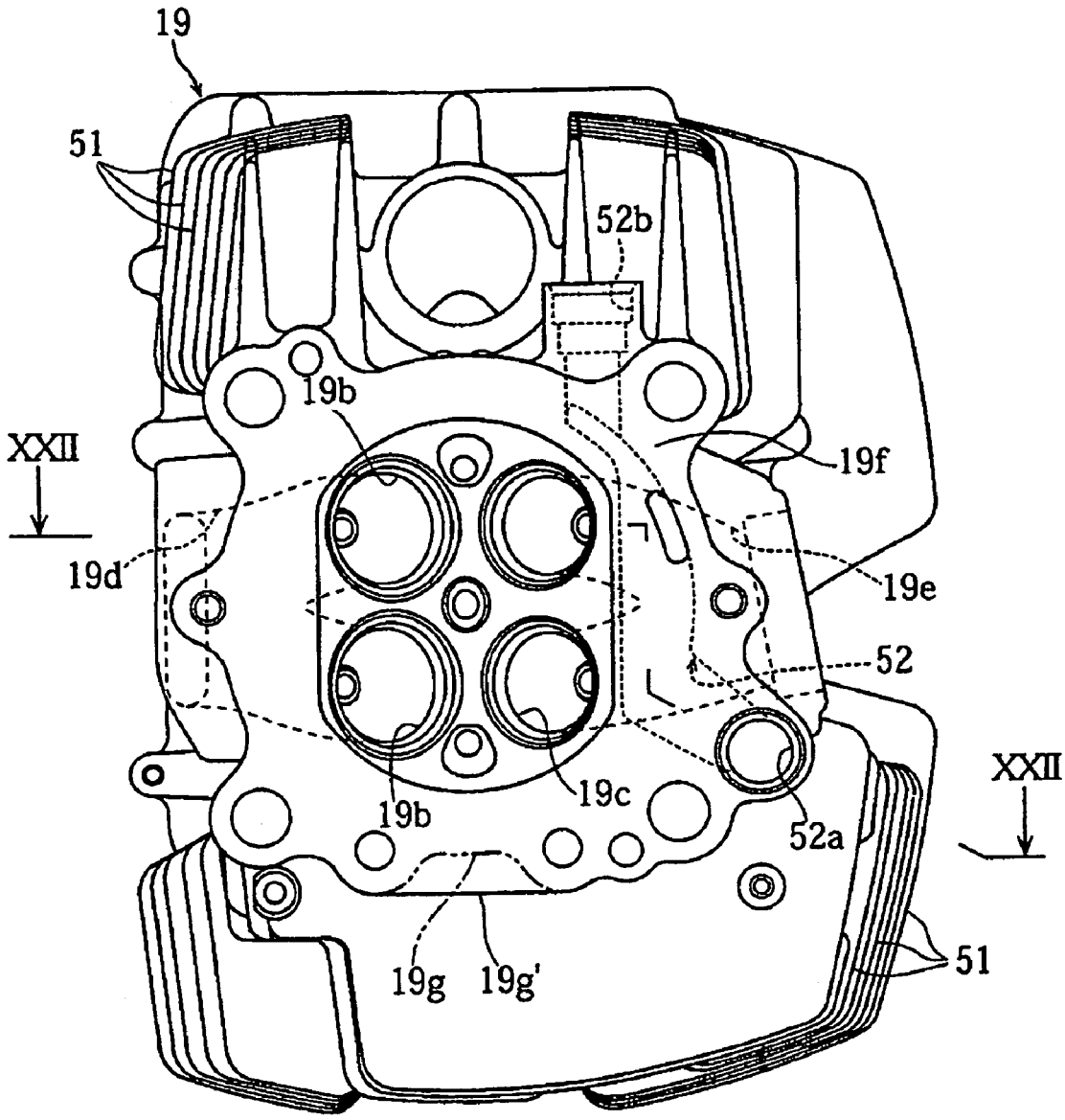
FIG. 21 is a bottom view of a cylinder head according to another embodiment of this invention.
Figure 22:
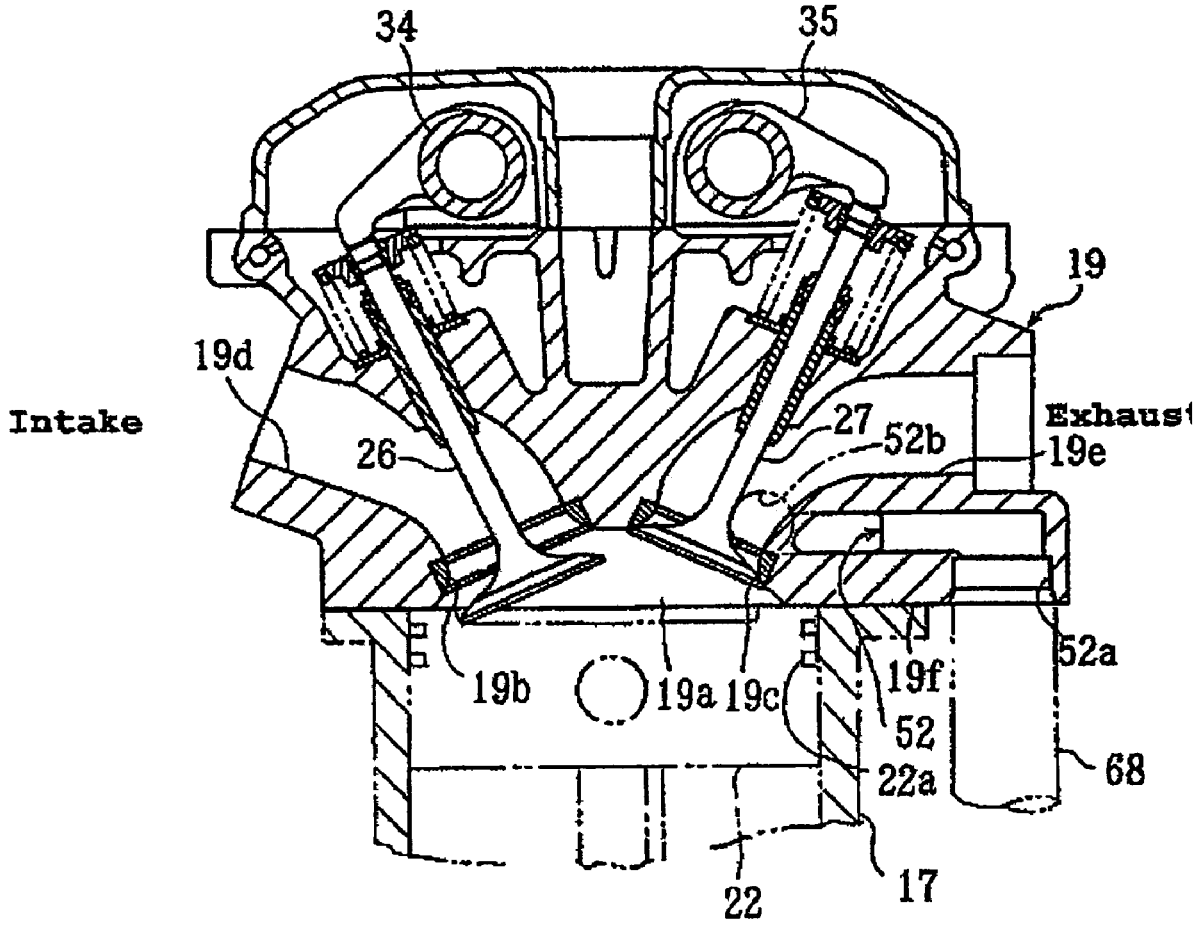
FIG. 22 is a sectional view taken along the line XXII—XXII of FIG. 21.

In the cooling structure of the foregoing embodiment, a case, where a cooling jacket 52 is formed passing under the intake and exhaust ports and surrounding the peripheral portion of the combustion recess, has been described, as an example. However, this invention is not limited to that. As shown in FIG. 21 and FIG. 22, the cooling jacket 52 may be formed in the cylinder head 19 between the exhaust port 19*e* and the lower mating surface 19*f* and only in a region corresponding to the exhaust valve opening 19*c*. In these figures, reference numerals, which are the same as in FIG. 11 and FIG. 12, designate the same or equivalent parts.

In this case, only a region around the exhaust port 19*e* subjected to the highest heat load is cooled, so that the capacity of the cooling jacket 52 can be further decreased to about 35 cc, thereby suppressing the size increase of the engine and securing the degree of freedom in designing.

Further, as shown in FIG. 21, a thick portion 19*g*' may be formed to fill the recessed portion in the right wall 19*g* of the cylinder head 19. This allows heat in the intake side to be transmitted easily to the cooling jacket 52 through the thick portion 19*g*', effecting a higher cooling efficiency.

Figure 23:
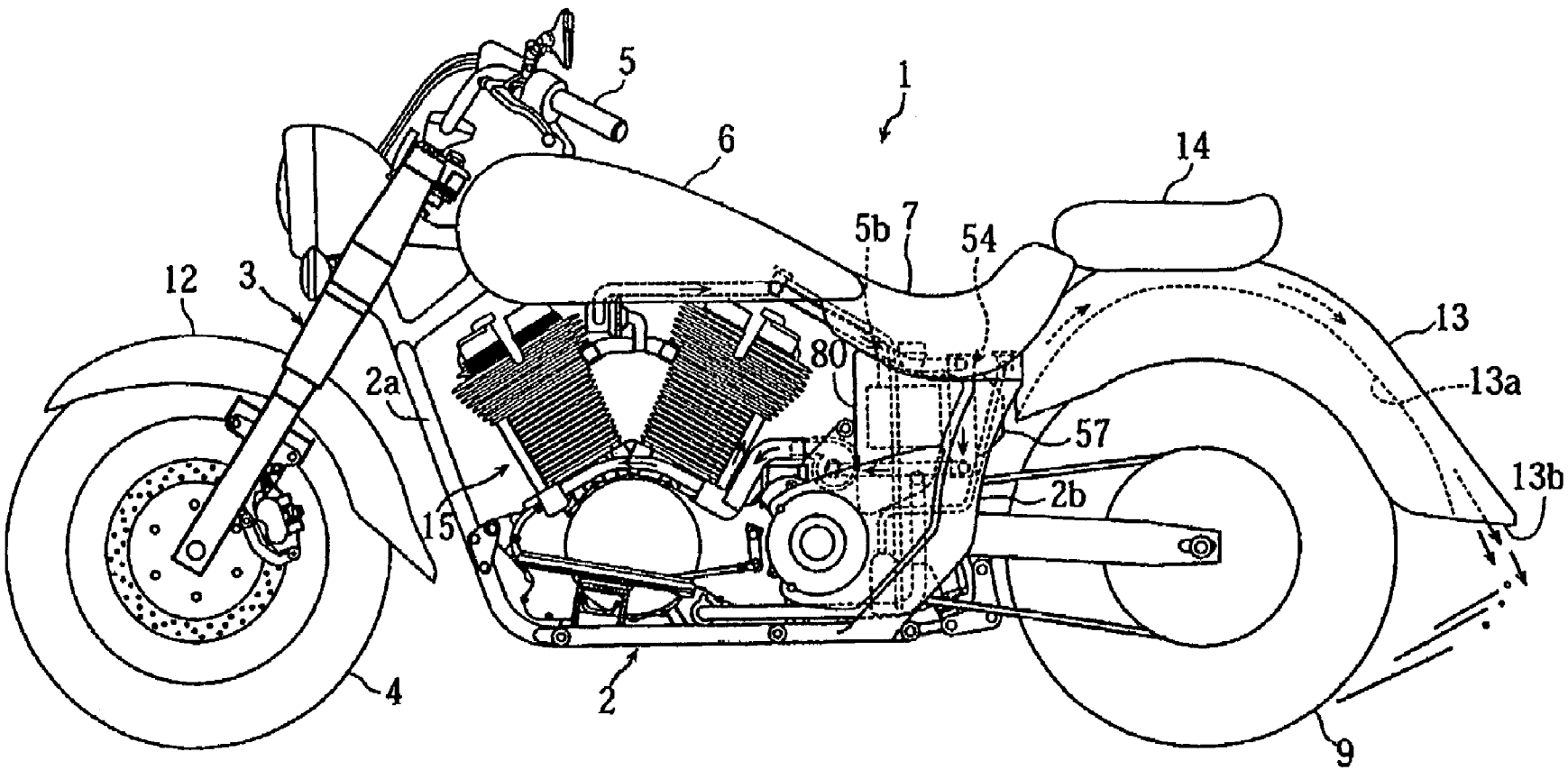
FIG. 23 is a view showing an arrangement of a radiator according to another embodiment of the present invention.

In the foregoing embodiment, a case, where a radiator 54 is disposed at the lower forward end of the body frame 2, has been described. However, this invention is not limited to that. As shown in FIG. 23, the radiator 54 may be disposed under the seat 7. An oil tank 80 and a battery 56 may be disposed parallel to each other in front of the radiator at the left and right sides. The rear wheel 9 and rear fender 13 may be disposed behind the radiator. Further, left and right rear arm brackets 2*b* of the body frame 2 at the left and right sides of the radiator 54 may also be provided. In the figure, reference numerals, which are the same as in FIG. 1, designate the same or equivalent parts.

As described above, the radiator 54 is disposed under the seat 7, with the front of the radiator 54 surrounded by the oil tank 80 and battery 56, the rear of the radiator surrounded by the rear wheel 9 and rear fender 13, and the left and right sides surrounded by the rear arm brackets 2*b*. Therefore, the radiator 54 can be disposed in an inconspicuous location. In other words, the radiator can be disposed in a location where its presence is not recognized easily, improving the external appearance of the air-cooled engine.

Furthermore, a duct 13*a* may be formed along the inside surface of the rear fender 13, with an upstream port 13*c* opened facing the fan 57 of the radiator 54 and a downstream port 13*b* opened facing the ground so that the cooling wind from the cooling fan 57 of the radiator 54 is discharged to the ground through the duct 13*a*. In this case, water splashing caused by the rear wheel 9 can be suppressed by the cooling wind discharged from the duct 13*a*, preventing muddy water from sticking to the inner side of the rear fencer 13.

Regarding the crankshaft 21, the left and right crank journals 21*c* are supported by bosses 16*c* formed in the left and right walls of the crankcase section 16*a*. On the crankshaft 21 is mounted, at the left end, a generator 83 through a starter gear 82, and at the right end is fixed a crank gear 85 by key fitting.

The transmission mechanism is disposed in the mission case section 16*b* of the crankcase 16, which includes a main shaft 87 having an input gear group 89, a drive shaft 88 having an output gear group 90 meshing the input gear group 89, and a shift drum 93 for guiding and supporting an input side shift fork 91 engaged with the input gear group 89 and two output side shift forks 92 engaged with the output gear group 90, each disposed parallel to the crankshaft 21. The input side shift fork 91 and output side shift forks 92 are supported by fork shafts 91*a*, 92*a*, 92*b* for movement in the axial direction.

A foot-operated shift lever 94 (see FIG. 8) is operated in a swinging manner, causing the shift drum 93 to rotate and the shift forks 91, 92 to move axially to connect any specified gears of the input and output gear groups 89, 90 to the main shaft 87 and drive shaft 88, so that switching is performed between the lowest and the highest speed.

The left end portion of the drive shaft 88 protrudes outward from the mission case section 16*b* and an unillustrated drive sprocket mounted on the protruding drive shaft 88 is connected to a follower sprocket 93*a* of the rear wheel 9 through a drive belt 93 (see FIG. 1).

A clutch mechanism 95 is provided at the right end of the main shaft 87. The clutch mechanism 95 includes an outer drum 96 mounted on the main shaft 87 for relative rotation, an inner drum 97 coupled to the main shaft 87 for rotation therewith, and numerous clutch plates 98 disposed between the outer and inner drums 96, 97. In the clutch mechanism 95, a push rod 99 inserted in the center of the main shaft 87 is advanced and retracted by a hydraulic piston 100*a* of a hydraulic cylinder member 100, to transmit or cut off engine power to the main shaft 97.

Now, the balancer structure of the engine 15 will be described with reference mainly to FIG. 3, FIG. 4, FIG. 6 and FIG. 7.

First and second balancer shafts 105, 106 are disposed, parallel to the crankshaft 21, in front of, and behind the crankshaft 21, respectively. The first and second balancer shafts 105, 106 are formed with weights 105*a*, 106*a* integrally and the balancer shafts 105, 106 are supported by the bosses 16*c* formed on the left and right walls of the crankcase section 16*a* through bearings 107, 108.

A first balancer gear 109 is fixed to the first balancer shaft 105 at the right end, and a second balancer gear 110 is fixed to the second balancer shaft 106 at the right end, each by key fitting. The first and second balancer gears 109, 110 mesh the crank gear 5 and the first and second balancer shafts 105, 106 are rotated at the same speed as the crankshaft 21 in the direction opposite to the rotation of the crankshaft 21.

The right end portion of the second balancer shaft 106 is formed with an extension 106*b* and a boss 110*a* formed on the second balancer gear 110 as its extension is fitted on the extension 106*b*. On the boss 110*a* and outside the second balancer gear 110 is mounted a counter gear 111 of the same diameter as the second balancer gear for relative movement, and the counter gear 111 is meshed with a large reduction gear 112 mounted on the main shaft 87 for relative rotation. Reference numeral 111*a* designates a scissors gear for absorbing the backlash between the counter gear 111 and the large reduction gear 112. As such, the extension 106*b* and thus the second balancer shaft 106 are also used as a counter shaft. The large reduction gear 112 is coupled to the outer drum 96 through a rubber damper 113.

A disc spring type torque damper 115 is provided outside the counter gear 111 of the second balancer gear 110. The torque damper 115, as shown in FIG. 7, is disposed on the downstream side of the engine power transmission path to the second balancer gear 110 of the second balancer shaft 106.

The torque damper 115 is constituted such that outside a lifter 116 formed with a projection 116*a* to be engaged with a recess 111*a* of the counter gear 111 is provided a pair of leaf springs 117 for pushing the lifter 116 and biasing it towards the counter gear 111, and outside the leaf springs 117 is disposed a spring receiving member 118.

The lifter 116 and spring receiving member 118 are spline-fitted on the boss 110*a* of the second balancer gear 110 for rotation with the second balancer gear 110 and for axial movement. The spring receiving member 118 is restricted for its outward movement in the axial direction by a cotter fitted in the boss 110*a*. When torque variations occur in the crankshaft 21 and excessive torque is transmitted to the counter gear 111, the lifter 116 moves axially outwardly against the biasing force of the leaf springs 117, causing a sliding movement of the counter gear 111 on the boss 110*a*, resulting in damping of the torque variations.

In this case, since the torque damper 115 is disposed on the downstream side of 103*a* rotation a transmission of the crankshaft 21 to the second balancer shaft 106, the foregoing sliding movement doesn't change the phase angle of the balancer shaft 106 and the function as a balancer is not hindered.

Now, the positional relation between the crankshaft 21, the first and second balancer shafts 105, 106, the main shaft 87, the drive shaft 88 and the shift drum 93 of the engine 15 will be described with reference mainly to FIG. 3.

The first balancer shaft 105 is disposed in front of a normal plane to the axis of the crankshaft 21 and above a horizontal line A passing through the center of the crankshaft 21, and the second balancer shaft 106 is disposed behind the normal plane and below the horizontal line A.

The main shaft 87 is disposed further rearward and further upward than the second balancer shaft 106, and the drive shaft 88 is disposed downward and rearward of the main shaft 87 and approximately on the horizontal line A. The shift drum 93 is disposed between the second balancer shaft 106 and the main shaft 87, that is, in front of the main shaft 87, and below the horizontal line A.

In the balancer structure of this embodiment as described above, a first balancer shaft 105 is disposed in front of a normal plane to the axis of the crankshaft 21, and a second balancer shaft 106 is disposed behind the normal plane. On the extension 106*b* of the second balancer shaft 106 is provided a counter gear 111 for transmitting the rotation of the crankshaft 21 to the main shaft 87. Therefore, the second balancer shaft 106 can be used as a counter shaft, and the longitudinal length of the crankcase 16 can be decreased by eliminating the amount corresponding to the space occupied by the counter shaft.

In this embodiment, a counter gear 111 and a disc spring type torque damper 115 are provided on the downstream side from the second balancer gear 110 fixed to the second balancer shaft 106. Therefore, the phase shift of the second balancer shaft 106 can be prevented at the time of the activation of the torque damper 115.

The main shaft 87 is disposed behind and above the second balancer shaft 106, and the shift drum 93 between the main shaft 87 and second balancer shaft 106, that is, in front of the main shaft 87. Therefore, the drive shaft 88 can be disposed closer to the crankshaft 21 compared with the prior art in which the shift drum is disposed behind the main shaft, and the longitudinal length of the crankcase 16 can be decreased.

In this embodiment, the first balancer shaft 105 is disposed above the horizontal line A passing through the center of the crankshaft 21, and the second balancer shaft 106 below the horizontal line. Therefore, the horizontal distance between the first and second balancer shafts 105, 106 on both sides of the crankshaft 21 can be decreased and thus the longitudinal length of the crankcase 12 can be decreased as well.

Now, a lubrication device of the engine 15 will be described with reference mainly to FIG. 14–FIG. 20.

The lubrication device of this embodiment is provided, as shown in FIG. 20, with a transmission lubrication system 126 for supplying lubricant in the oil tank 80 to the transmission by an oil feed pump 124*c*, and an engine lubrication system 127 for supplying oil to the engine, and the engine lubrication system 127 is branched into a cam lubrication system 127*a* and a cylinder lubrication system 127*b*. In these lubrication systems, lubricant falls into the oil sump 16*e* at the bottom of the crankcase 16 and is drawn up from the reservoir by oil scavenging pumps 124*a*, 124*b* to be returned to the oil tank 80.

In the transmission lubrication system 126, lubricant is supplied from the main shaft to the input gear group and the clutch mechanism, to the drive shaft and the shift fork through a mission shower, and thereafter to the output gear group.

In the cam lubrication system 127*a*, lubricant is supplied from a right crank journal to left front and rear cam journals, a front connecting rod large end and a hydraulic tensioner in a branched manner. The lubricant supplied to the left front cam journal is supplied from a front hydraulic lifter and a right front cam journal to a front rocker arm through a front push rod. The lubricant supplied to the left rear cam journal is supplied from a rear hydraulic lifter and a right rear cam journal to a rear rocker arm through a rear push rod. The lubricant supplied to the front connecting rod is supplied to a front piston.

In the cylinder lubrication system 127*b*, lubricant is supplied from a left crank journal to the front and rear cylinder heads, an ACM coil, a rear connecting rod large end and a starter one way in a branched manner. The lubricant supplied to the front and rear cylinder heads is supplied separately to front and rear valve stem ends and the lubricant supplied to the rear connecting rod is supplied to a rear piston. The lubricant falls to the bottom of the crankcase through unillustrated passages after lubricating moving parts to be lubricated.

An oil filter 130 is mounted detachably to the lower end of a rear wall 16*d* of the crankcase 16. The oil filter 130 is constituted such that an oil element 131 is provided in a filter chamber 130*a* and the filter chamber 130*a* is divided into an oil inflow chamber 130*b* and an oil outflow chamber 130*c* by the oil element 131. The oil inflow chamber 130*b* is in communication with an inflow passage 16*f* formed on the rear wall 16*d* and the oil inflow chamber 130*c* is in communication with an outflow passage 16*g* formed on the rear wall 16*d*.

To the outflow passage 16*g* of the rear wall 16*d* is connected a main gallery 128. The main gallery 128 is in communication with left and right crank journals 21*c*. In the crankcase 16 is formed a mission passage 129 in communication with the upstream end of the main gallery 128, and the mission passage 129 is in communication with a boss 87*a* supporting the right end of the main shaft 87.

The oil scavenging pumps 124*a*, 124*b* and an oil pump 125 acting as the oil feed pump 124*c* are disposed under the shift drum 93 in the crankcase 16. The oil pump 125 has a housing 125*a* fixed to the inner side of a right wall 16*h* of the crankcase 16, and a pump shaft 125*b* inserted for rotation in the housing 125*a* and disposed parallel to the crankshaft 21. A pump gear 133 is mounted to the left end portion of the pump shaft 125*b* protruding from the housing 125*a*. The pump gear 133, as shown in FIG. 6, meshes a drive gear 134 mounted on the left end of the second balancer shaft 106 through a middle gear 135 so that rotation of the crankshaft 21 causes the pump shaft 125*b* to rotate.

As shown in FIG. 16, first and second pump chambers 136*a*, 136*b* acting as the oil scavenging pumps 124*a*, 124*b* and a third pump chamber 136*c* acting as the oil feed pump 124*c* are formed, separate from each other, around the pump shaft 125*b* in the housing 125*a*. First, second and third rotors 137*a*, 137*b*, 137*c* mounted on the pump shaft 125*b* are provided in the pump chambers 136*a*–136*c*, respectively.

A suction passage 138*a* is formed on the upstream side of the third pump chamber 136*c* in the housing 125*a*, and a delivery passage 138*b* is formed on the downstream side. To the suction passage 138*a* is connected a downstream end of an oil feed pipe 132 connected to the oil tank 80. Also, the oil inflow chamber 130*b* of the oil filter 130 is connected to the delivery passage 138*b*, with a check valve 139 for preventing back flow of the lubricant placed therebetween.

First and second collection passages 140*a*, 140*b* are formed independently on the upstream side of the first and second pump chambers 136*a*, 136*b* in the housing 125*a*, respectively, and a joined flow passage 140*c* is formed on the downstream side. An oil return pipe 141 is connected to the joined flow passage 140*c*, and the downstream end of the oil return pipe 141 is connected to the oil tank 80.

An approximately flat oil sump 16*e* is formed at the bottom of the crankcase 16. Inside the crankcase 16 is formed an arcuate partition wall 16*i* surrounding the lower part of the rotation locus of the crank arm 21*b*, and at the forward end of the partition wall 16*i* is formed a cutout 16*j* extending over the entire width. The partition wall 16*i* serves as a means of preventing lubricant from being stirred up in the oil sump 16*e* due to the rotation of the crankshaft 21. The cutout 16*j* is an opening through which lubricant splashed by the crankshaft 21 is returned to the oil sump 16*e*.

Here, the partition wall 16*i* is formed in an arcuate shape and the portion of the partition wall under the crankshaft is brought close to the bottom of the crankcase 16. Therefore, the oil sump 16*e* in this embodiment can be considered as being divided substantially into a front (the other side) portion 16*e*' and a rear (one side) portion 16*e*" of the normal plane B including the axis of the crankshaft 21.

Front and rear suction ports 142, 143 are provided in the front portion 16*e*' and rear portion 16*e*" of the oil sump 16*e* on both sides of the crankshaft 21, respectively. Here, the front portion 16*e*' and the rear portion 16*e*" of the oil sump 16*e* are portions where lubricant is likely to be swept in and accumulated due to pressure variations associated with the rotation of the crankshaft 21 and reciprocating movement of the piston, and the front and rear suction ports 142, 143 are disposed in such portions.

As described above, in this embodiment, the oil sumps and oil suction ports are provided respectively in front of and behind the normal plane B including the axis of the crankshaft 21, and the oil pump is provided only on the rear oil sump behind the normal plane.

The rear suction port 143 is connected to the first collection passage 140*a* of the oil pump 125 integral therewith, which opens downward close to the bottom of the crankcase. A plate-like rear strainer 143 is provided in the rear suction port 143.

The front suction port 142 is formed under the partition wall 16*i* of the right wall 16*h* of the crankcase 16. A cylindrical front strainer 144 is inserted in the front suction port 142, and a drawing pipe 145 is connected to the strainer 144. The drawing pipe 145 is provided extending longitudinally outside the right wall 16*h*, and the downstream end of the drawing pipe 145 is connected to the second collection passage 140*b* of the oil pump 125. The drawing pipe 145, as shown in FIG. 17, is disposed below the crank arm 21*b* of the crankshaft 21 in a region offset from the crank arm 21*b* in the axial direction of the crankshaft.

A description will next be made of the functions and the effects of the embodiments of the present invention.

In the lubrication device of this embodiment, suction ports 142, 143 are disposed in the front portion 16*e*' and the rear portion 16*e*" of the oil sump 16*e* on both sides of the normal plane B including the axis of the crankshaft 21. Therefore, lubricant can be collected reliably without accumulation even if it is dispersed forward and rearward of the oil sump 16*e*. As a result, the bottom of the crankcase 16 can be elevated, the engine height can be suppressed that much, and the problem of accumulation of lubricant can be resolved when the engine displacement is increased, for example, to 1000 cc or larger.

In this embodiment, the suction ports 142, 143 are disposed in the front portion 16*e*' and the rear portion 16*e*" of the oil sump 16*e*, which means that they are disposed in locations where lubricant is most likely to be accumulated. Therefore, collection efficiency of the lubricant is enhanced.

In this embodiment, the oil sumps are disposed respectively in front of and behind the crankshaft 21, the oil pump 125 is provided on only one of the oil sumps, which is disposed behind the crankshaft, and oil in the front oil is drawn through the oil drawing pipe 145. Therefore, only one oil pump is required, preventing an increase in the number of parts used, and a complicated drive system of the oil pump.

Also, on the pump shaft 125*b* of the oil pump 125 are mounted first and second rotors 137*a*, 137*b* for sucking lubricant from the suction ports 142, 143, and a third rotor 137*c* for delivering lubricant in the oil tank 80. Therefore, if one oil pump 125 is only disposed in the crankcase 16, the pump is allowed to act as two scavenging pumps 124*a*, 124*b* and one oil feed pump 124*c*, preventing an increase in the size of the lubrication system.

Figure 24:
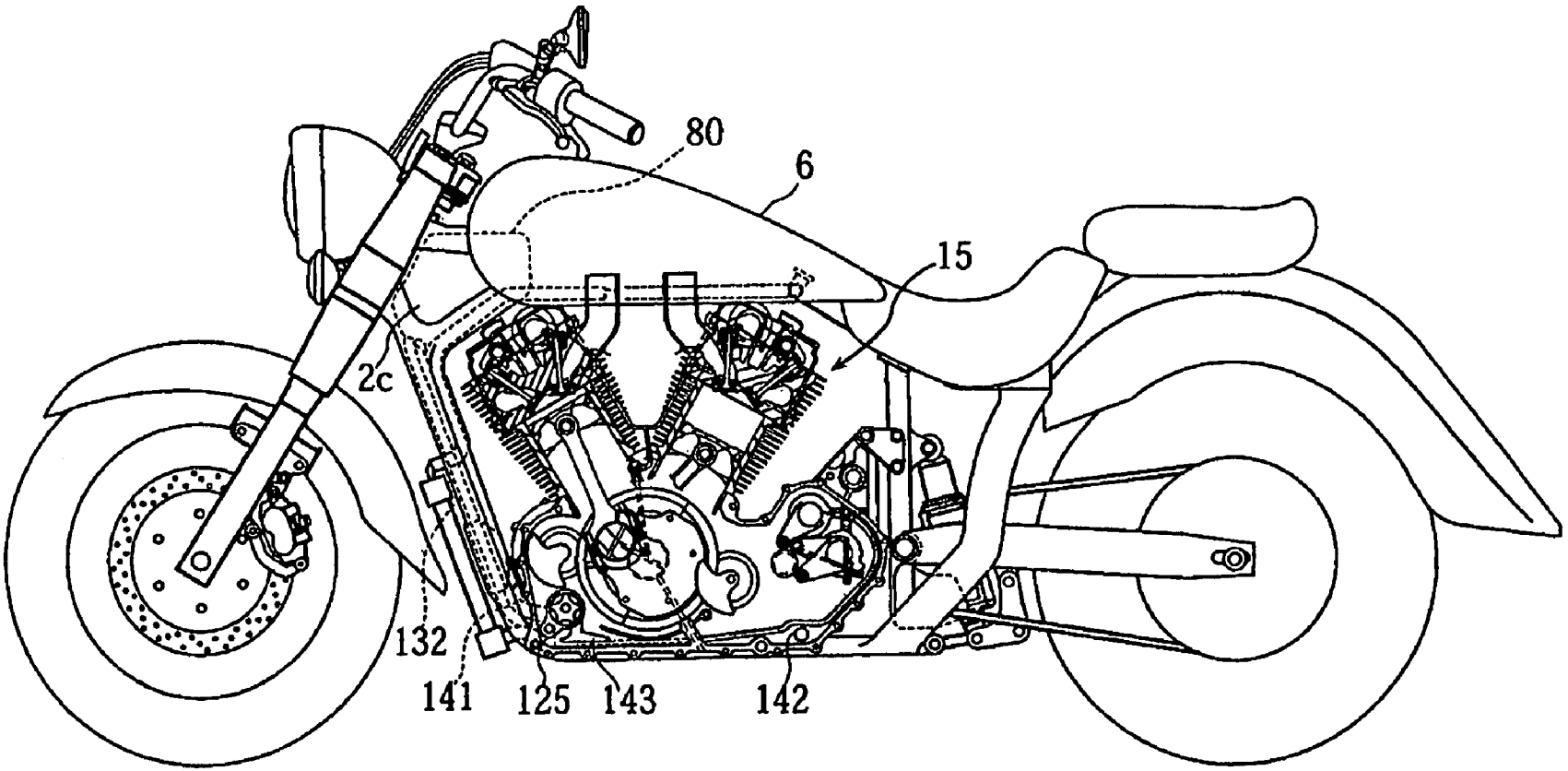
FIG. 24 is a view showing an arrangement of an oil tank according to still another embodiment of the present invention.

In the foregoing embodiment, a case, where an oil tank 80 is disposed under the seat, has been described. However, this invention is not limited to that. As shown in FIG. 24, the oil tank 80 may be disposed in a space behind the head pipe (not shown) and surrounded by the gusset 2*c* and the fuel tank 9. In this case, the oil pump 125 may be disposed at the forward end of the bottom of the crankcase.

In this case, the oil tank 80 is disposed by utilizing a vacant space at the front of the body frame 2, and the piping distance between the oil tank 80 and oil pump 125 can be decreased compared with when the oil tank is disposed under the seat, simplifying the lubrication path.

In the example of FIG. 24, the oil tank 80 may be disposed on the body frame forward from the engine. For example, the oil tank may be supported by the down tubes 2*a* such that the oil tank can be positioned adjacent to the radiator 54.

What is claimed is:

1. A lubrication system for an engine, comprising:

an oil tank;

a crankshaft;

a crankcase for housing the crankshaft;

an oil sump formed at a bottom of the crankcase collecting lubricant for circulated moving parts to be lubricated; and an oil pump for returning the lubricant collected in the oil sump to the oil tank, wherein oil suction ports are provided on one side and another side of a vertical plane including an axis of the crankshaft, and the oil sump is provided on both of the one side and the another side.

2. The lubrication system for an engine according to claim 1, wherein the oil pump is provided only on the one side, and the oil suction port is provided on the another side connected to the oil pump through a suction passage.

3. The lubrication system for an engine according to claim 2, wherein the suction passage is disposed in a region offset from a crank arm in an axial direction of the crankshaft.

4. The lubrication system for an engine according to claim 3, wherein the suction passage is formed with a separate pipe member from the crankcase, and disposed outside of the crankcase.

5. The lubrication system for an engine according to claim 2, wherein on one pump shaft of the oil pump are mounted first and second rotors for sucking lubricant accumulated in the oil sump from the suction port, and a third rotor for delivering lubricant in the oil tank to the moving parts to be lubricated.

6. The lubrication system for an engine according to claim 1, wherein the engine is designed for motorcycles, and the oil pump is provided at a forward end of a vehicle in the crankcase, and the oil tank is disposed on a body frame forward from the engine.

7. The lubrication system for an engine according to claim 1, wherein the engine is designed for motorcycles, and the crankshaft is disposed in a lateral direction of a vehicle.

8. The lubrication system for an engine according to claim 1, wherein the crankcase include a mission case.

9. The lubrication system for an engine according to claim 1, wherein the crankcase is disposed horizontally in a lateral direction.

10. A lubrication system for an engine, comprising:

an oil tank;

a crankshaft;

a crankcase for housing the crankshaft;

means for collecting lubricant for circulated moving parts to be lubricated; and an oil pump for returning the lubricant collected in the means for collecting to the oil tank, wherein oil suction ports are provided on one side and another side of a vertical plane including an axis of the crankshaft, and the means for collectin is provided on both of the one side and the another side.

11. The lubrication system for an engine according to claim 10, wherein the oil pump is provided only on the one side, and the oil suction port is provided on the another side connected to the oil pump through a suction passage.

12. The lubrication system for an engine according to claim 11, wherein the suction passage is disposed in a region offset from a crank arm in an axial direction of the crankshaft.

13. The lubrication system for an engine according to claim 12, wherein the suction passage is formed with a separate pipe member from the crankcase, and disposed outside of the crankcase.

14. The lubrication system for an engine according to claim 11, wherein on one pump shaft of the oil pump are mounted first and second rotors for sucking lubricant accumulated in the means for collecting from the suction port, and a third rotor for delivering lubricant in the oil tank to the moving parts to be lubricated.

15. The lubrication system for an engine according to claim 10, wherein the crankcase include a mission case.

16. A method for lubricating, comprising:

collecting lubricant for circulated moving parts to be lubricated;

returning the lubricant collected in an oil sump to an oil tank; and providing oil suction ports on one side and another side of a vertical plane including an axis of a crankshaft, and the oil sump on both of the one side and the another side.

17. The method according to claim 16, further comprising providing an oil pump only on the one side and the oil suction port on the another side connected to the oil pump through a suction passage.

18. The method according to claim 17, further comprising disposing the suction passage in a region offset from a crank arm in an axial direction of the crankshaft.

19. The method according to claim 17, further comprising forming the suction passage with a separate pipe member from a crankcase, disposed outside of the crankcase.

* * * * *